US009069276B2

(12) United States Patent
Hayashi et al.

(10) Patent No.: US 9,069,276 B2
(45) **Date of Patent: *Jun. 30, 2015**

(54) LIQUID DEVELOPER

(71) Applicant: Konica Minolta, Inc., Chiyoda-ku (JP)

(72) Inventors: Kenji Hayashi, Hachiouji (JP); Masahiro Anno, Sakai (JP); Yukiko Uno, Kyoto (JP); Satoshi Matsumoto, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/034,625

(22) Filed: Sep. 24, 2013

(65) Prior Publication Data

US 2014/0087303 A1 Mar. 27, 2014

(30) Foreign Application Priority Data

Sep. 26, 2012 (JP) ..... 2012-212407

(51) Int. Cl.
*G03G 9/13* (2006.01)
*G03G 9/12* (2006.01)

(52) U.S. Cl.
CPC . *G03G 9/122* (2013.01); *G03G 9/13* (2013.01)

(58) Field of Classification Search
CPC ..... G03G 9/13
USPC ..... 430/114, 115
See application file for complete search history.

(56) References Cited

U.S. PATENT DOCUMENTS

2003/0134940 A1 * 7/2003 Morrison et al. ..... 430/114
2014/0087300 A1 * 3/2014 Uno et al. ..... 430/137.22

FOREIGN PATENT DOCUMENTS

JP 03078775 A * 4/1991
JP 10-207130 A 8/1998
JP 2002-202645 A 7/2002

* cited by examiner

*Primary Examiner* — Christopher Rodee
(74) *Attorney, Agent, or Firm* — Buchanan Ingersoll & Rooney PC

(57) ABSTRACT

A liquid developer is obtained by dispersing toner particles containing at least a resin and a coloring agent in an insulating liquid. The toner particles have a core-shell structure that first resin particles containing a first resin are attached to or cover surfaces of second resin particles containing a second resin. The coloring agent contains nigrosine. A content of nigrosine in the toner particles is not lower than 1 mass % and not higher than 20 mass %. The second resin satisfies Equations (1) to (2) below. In Equations (1) to (2), x represents a number average molecular weight of the second resin and y represents a urethane group concentration (mass %) in the second resin.

$$-0.00003x+2.03 \leq y \leq -0.00003x+6.95 \quad \text{Equation (1)}$$

$$10000 \leq x \leq 60000 \quad \text{Equation (2)}$$

3 Claims, 2 Drawing Sheets

LIQUID DEVELOPER

This application is based on Japanese Patent Application No. 2012-212407 filed with the Japan Patent Office on Sep. 26, 2012, the entire content of which is hereby incorporated by reference.

BACKGROUND OF THE INVENTION

1. Field of the Invention

The present invention relates to a liquid developer.

2. Description of the Related Art

A powdery developer (what is called toner) has conventionally been employed as a developer used in an image formation apparatus of an electrophotography type. With the powdery developer, even when a content of a coloring agent is not higher than 10 mass % with respect to 100 mass % of a resin because of increase in particle size (such as 5 μm or greater) from a point of view of prevention of scattering or the like, an image of high density can be obtained.

On the other hand, with a liquid developer, since toner particles are dispersed in an insulating liquid, the toner particles can be prevented from scattering in atmosphere even when a particle size of the toner particles is made smaller. Thus, since a liquid developer can have a smaller particle size of the toner particles, a high-quality image is obtained. When a particle size of the toner particles is made smaller, however, a high-density image is less likely to be obtained and hence a content of the coloring agent should be increased. When the content of the coloring agent is increased, viscoelasticity of a resin contained in the toner particles becomes higher (a filler effect), which may cause deterioration in fixability of the toner particles and resultant lowering in glossiness of an image.

For example, Japanese Laid-Open Patent Publication No. 2002-202645 describes a method for improving glossiness of an image. This publication describes a method for improving fixability without impairing uniformity of an image by forming a water-clear toner layer on a color toner image once formed, and describes increase in gloss of an image with an amount of attached transparent toner.

Japanese Laid-Open Patent Publication No. 10-207130 describes a method for providing a surface of an image with gloss. This publication describes a method for coating an output image surface by applying a solution mainly composed of an organopolysiloxane copolymer obtained by grafting a vinyl-based compound or a copolymer obtained by making blocks of organopolysiloxane from a vinyl-based compound to the image surface and drying the same.

SUMMARY OF THE INVENTION

With the method described in Japanese Laid-Open Patent Publication No. 2002-202645, a development system for forming a water-clear toner layer should be added to an image formation apparatus. Therefore, it is difficult to reduce a size of an image formation apparatus.

With the method described in Japanese Laid-Open Patent Publication No. 10-207130, a liquid improving gloss of an output image is applied to a surface of the image. Therefore, blur, displacement, or the like of an image may be caused.

The present invention was made in view of such aspects, and an object thereof is to improve glossiness of an image without causing increase in size and complication of an image formation apparatus or without causing blur, displacement, or the like of an image.

A liquid developer according to the present invention is obtained by dispersing toner particles containing at least a resin and a coloring agent in an insulating liquid. The toner particles have a core-shell structure that first resin particles containing a first resin are attached to or cover surfaces of second resin particles containing a second resin. The coloring agent contains nigrosine. A content of nigrosine in the toner particles is not lower than 1 mass % and not higher than 20 mass %. The second resin satisfies Equations (1) to (2) below. In Equations (1) to (2) below, x represents a number average molecular weight of the second resin and y represents a urethane group concentration (mass %) in the second resin.

$$-0.00003x+2.03 \leq y \leq -0.00003x+6.95 \quad \text{Equation (1)}$$

$$10000 \leq x \leq 60000 \quad \text{Equation (2)}$$

The coloring agent preferably contains nigrosine and carbon black. Preferably, a total content of nigrosine and carbon black in the toner particles is not lower than 15 mass % and not higher than 50 mass %.

Preferably, the toner particles have a volume average particle size not smaller than 0.5 μm and not greater than 5 μm.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
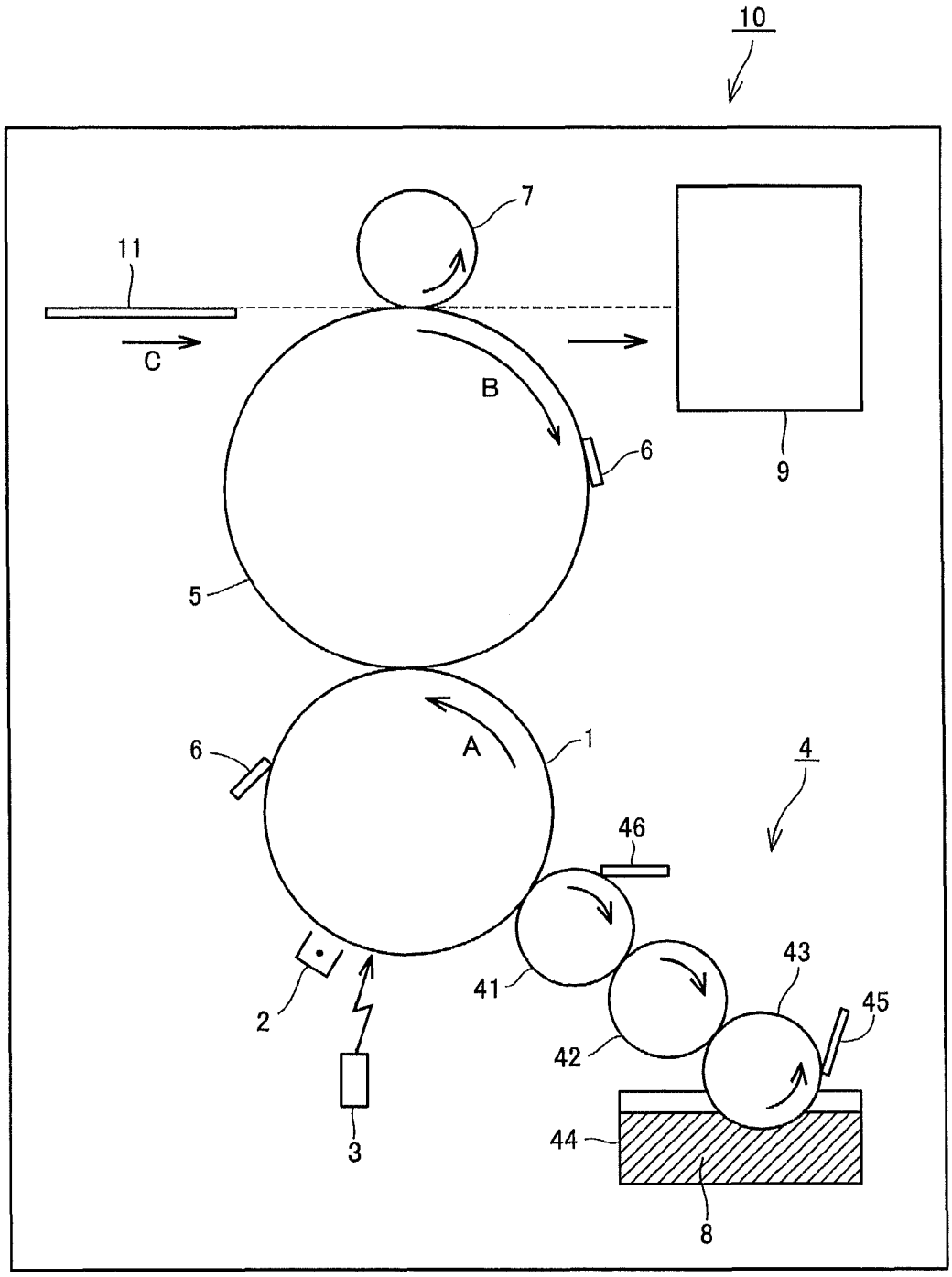
FIG. 1 is a cross-sectional view showing one example of an image formation apparatus.

A liquid developer according to the present invention will be described below. It is noted that the same reference numerals in the drawings of the present invention refer to the same or corresponding elements. In addition, relation of such a dimension as a length, a width, a thickness, or a depth is modified as appropriate for clarity and brevity of the drawings and does not represent actual dimensional relation.

[Construction of Liquid Developer]

A liquid developer (X) according to the present embodiment is used in an image formation apparatus of an electrophotography type (such as an image formation apparatus shown in FIG. 1) such as a copying machine, a printer, a digital printer, or a simple printer, and it is obtained by dispersing toner particles (C) having a core-shell structure in an insulating liquid (L). In the liquid developer (X) according to the present embodiment, a resin of which number average molecular weight (hereinafter abbreviated as "Mn") and urethane group concentration satisfy Equations (1) to (2) above is employed as a resin forming a core layer and a prescribed content of nigrosine is employed as a coloring agent. Thus, even when a content of a coloring agent in the toner particles (C) is higher, fixability of the toner particles (C) is improved and hence glossiness of an image is improved. In addition, since glossiness of an image is improved by devising composition of the liquid developer (X), glossiness of an image can be improved without causing increase in size and complication of an image formation apparatus or without causing blur, displacement, or the like of an image.

In general, as a content of a coloring agent in toner particles is higher, viscoelasticity of a resin contained in the toner particles is higher (a filler effect), which causes lowering in fixability of the toner particles. With the liquid developer (X) according to the present embodiment, however, the resin forming the core layer satisfies Equations (1) to (2) above, and therefore, melt viscosity and elasticity of the resin forming the core layer are optimized. Therefore, even when a content of a coloring agent in the toner particles (C) is higher, viscoelasticity of the resin contained in the toner particles (C) is prevented from becoming higher. Accordingly, fixability of the toner particles (C) is improved and thus glossiness of an image is improved.

Additionally, since nigrosine is employed as a coloring agent, the resin molten at the time of fixation is crystallized at a lower temperature, because nigrosine has a property to lower a crystallization temperature of a crystalline resin. Therefore, since timing of crystallization of a resin is delayed in the liquid developer (X) according to the present embodiment as compared with a case where nigrosine is not contained as a coloring agent, a surface of an image can be smoothened, which also improves glossiness of an image.

The core-shell structure is such a structure that a first resin particles (A) containing a first resin (a) are attached to or cover surfaces of second resin particles (B) containing a second resin (b). The "first resin (a)" and the "first resin particles (A)" are hereinafter denoted as a "shell resin (a)" and a "shell particle (A)", respectively, and the "second resin (b)" and the "second resin particles (B)" are denoted as a "core resin (b)" and "core particles (B)", respectively.

<Shell Resin (a)>

The shell resin (a) in the present embodiment may be a thermoplastic resin or a thermosetting resin. The shell resin (a) is preferably, for example, a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, a polycarbonate resin, or the like. Two or more of these may be used together.

From a point of view of ease in obtaining the liquid developer (X) according to the present embodiment, the shell resin (a) is preferably at least one of a vinyl resin, a polyester resin, a polyurethane resin, and an epoxy resin, and more preferably at least one of a polyester resin and a polyurethane resin.

<Vinyl Resin>

A vinyl resin may be a polymer obtained by homopolymerizing a monomer having polymeric double bond (a homopolymer containing a bonding unit derived from a vinyl monomer) or a copolymer obtained by copolymerizing two or more types of monomers having polymeric double bond (a copolymer containing a bonding unit derived from a vinyl monomer). A monomer having polymeric double bond is preferably, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below, aromatic hydrocarbon having polymeric double bond shown in (1-2) below, or the like.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below, cyclic hydrocarbon having polymeric double bond shown in (1-1-2) below, or the like.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene), alkadiene having a carbon number from 4 to 30 (such as butadiene, isoprene, 1,4-pentadiene, 1,5-hexadiene, or 1,7-octadiene), or the like.

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexene, or ethylidene bicycloheptene), mono- or di-cycloalkadiene having a carbon number from 5 to 30 (such as monocyclopentadiene or dicyclopentadiene), or the like.

(1-2) Aromatic Hydrocarbon Having Polymeric Double Bond

Aromatic hydrocarbon having polymeric double bond is preferably, for example, styrene, vinyl naphthalene, or a hydrocarbyl (such as alkyl, cycloalkyl, aralkyl, and/or alkenyl having a carbon number from 1 to 30) substitute of styrene (such as x-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene), or the like.

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth) acrylic acid, crotonic acid, isocrotonic acid, or cinnamic acid], unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid], monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester), or the like. "(Meth)acrylic acid" herein means acrylic acid and/or methacrylic acid.

Salt of the monomer above is preferably, for example, alkali metal salt (such as sodium salt or potassium salt), alkaline earth metal salt (such as calcium salt or magnesium salt), ammonium salt, amine salt, quaternary ammonium salt, or the like.

Amine salt is not particularly limited so long as it is an amine compound. Amine salt is preferably, for example, primary amine salt (such as ethylamine salt, butylamine salt, or octylamine salt), secondary amine salt (such as diethylamine salt or dibutylamine salt), tertiary amine salt (such as triethylamine salt or tributylamine salt), or the like.

Quaternary ammonium salt is preferably, for example, tetraethyl ammonium salt, triethyl lauryl ammonium salt, tetrabutyl ammonium salt, tributyl lauryl ammonium salt, or the like.

Salt of the monomer having a carboxyl group and polymeric double bond is preferably, for example, sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, aluminum acrylate, or the like.

(3) Monomer Having Sulfo Group and Polymeric Double Bond and Salt Thereof

A monomer having a sulfo group and polymeric double bond is preferably, for example, alkene sulfonic acid having a carbon number from 2 to 14 [such as vinyl sulfonic acid, (meth)allyl sulfonic acid, or methyl vinyl sulfonic acid], styrene sulfonic acid, an alkyl (having a carbon number from 2 to 24) derivative of styrene sulfonic acid (such as α-methylstyrene sulfonic acid), sulfo(hydroxy)alkyl-(meth)acrylate having a carbon number from 5 to 18 [such as sulfopropyl (meth) acrylate, 2-hydroxy-3-(meth)acryloxy propylsulfonic acid, 2-(meth)acryloyloxyethane sulfonic acid, or 3-(meth)acryloyloxy-2-hydroxypropane sulfonic acid], sulfo(hydroxy) alkyl (meth)acrylamide having a carbon number from 5 to 18 [such as 2-(meth)acryloylamino-2,2-dimethylethane sulfonic acid, 2-(meth)acrylamide-2-methylpropane sulfonic acid, or 3-(meth)acrylamide-2-hydroxypropane sulfonic acid], alkyl (having a carbon number from 3 to 18) allylsulfo succinic acid (such as propylallylsulfo succinic acid, butylallylsulfo succinic acid, or 2-ethylhexyl-allylsulfo succinic acid), poly-[n ("n" representing a degree of polymerization; to be understood similarly hereinafter)=2 to 30]oxyalkylene (such as oxyethylene, oxypropylene, or oxybutylene; polyoxyalkylene may be a homopolymer of oxyalkylene or a copolymer of oxyalkylene; if polyoxyalkylene is a copolymer of oxyalkylene, it may be a random polymer or a block polymer), sulfate ester of mono(meth)acrylate [such as sulfate ester of poly-(n=5 to 15) oxyethylene monomethacrylate or sulfate ester of poly-(n=5 to 15) oxypropylene monomethacrylate], a compound expressed with Chemical Formulae (1) to (3) below, or the like.

Chemical Formula (1)

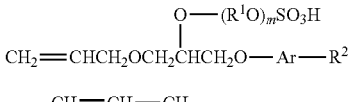

Chemical Formula (2)

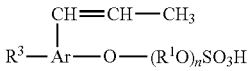

Chemical Formula (3)

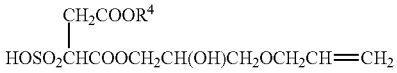

In Chemical Formulae (1) to (3) above, $R^1$ represents an alkylene group having a carbon number from 2 to 4. When Chemical Formula (1) includes two or more $R^1$Os, two or more $R^1$Os may be composed of the same alkylene group or of two or more types of alkylene groups as combined. When two or more types of alkylene groups are used as combined, a sequence of $R^1$ in Chemical Formula (1) may be a random sequence or a block sequence. $R^2$ and $R^3$ each independently represent an alkyl group having a carbon number from 1 to 15. m and n are each independently an integer from 1 to 50. Ar represents a benzene ring. $R^4$ represents an alkyl group having a carbon number from 1 to 15, which may be substituted with a fluorine atom.

Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, (meth)acryloyloxy alkyl phosphate monoester (a carbon number of an alkyl group being from 1 to 24) [such as 2-hydroxyethyl (meth) acryloyl phosphate or phenyl-2-acryloyloxy ethyl phosphate], (meth)acryloyloxy alkyl phosphonic acid (a carbon number of an alkyl group being from 1 to 24) (such as 2-acryloyloxy ethyl phosphonic acid), or the like.

Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol (meth)acrylamide, hydroxyethyl (meth)acrylate, hydroxypropyl (meth)acrylate, polyethylene glycol mono (meth)acrylate, (meth)allyl alcohol, crotyl alcohol, isocrotyl alcohol, 1-butene-3-ol, 2-butene-1-ol, 2-butene-1,4-diol, propargyl alcohol, 2-hydroxyethyl propenyl ether, sucrose allyl ether, or the like.

(6) Nitrogen Containing Monomer Having Polymeric Double Bond

A nitrogen containing monomer having polymeric double bond is preferably, for example, a monomer shown in (6-1) to (6-4) below.

(6-1) Monomer Having Amino Group and Polymeric Double Bond

A monomer having an amino group and polymeric double bond is preferably, for example, aminoethyl (meth)acrylate, dimethylaminoethyl (meth)acrylate, diethylaminoethyl (meth)acrylate, t-butylaminoethyl methacrylate, N-aminoethyl (meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, or the like.

The monomer having an amino group and polymeric double bond may be the salts of the monomer listed above. The salts of the monomer listed above are preferably, for example, salts listed as the "salt of the monomer above" in "(2) Monomer Having Carboxyl Group and Polymeric Double Bond" above.

(6-2) Monomer Having Amide Group and Polymeric Double Bond

A monomer having an amide group and polymeric double bond is preferably, for example, (meth)acrylamide, N-methyl (meth)acrylamide, N-butyl acrylamide, diacetone acrylamide, N-methylol (meth)acrylamide, N,N'-methyl ene-bis (meth)acrylamide, cinnamic acid amide, N,N-dimethylacrylamide, N,N-dibenzylacrylamide, methacrylformamide, N-methyl-N-vinylacetamide, N-vinylpyrrolidone, or the like.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, cyanoacrylate, or the like.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene or the like.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl (meth)acrylate or the like.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethyl styrene, tetrafluorostyrene, chloroprene, or the like.

(9) Others

Other than the monomers above, a monomer having polymeric double bond is preferably a monomer shown in (9-1) to (9-4) below.

(9-1) Ester Having Carbon Number from 4 to 16 and Having Polymeric Double Bond

An ester having a carbon number from 4 to 16 and having polymeric double bond is preferably, for example, vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxy acetate, vinyl benzoate, ethyl-α-ethoxy acrylate, alkyl (meth)acrylate having an alkyl group having a carbon number from 1 to 11 [such as methyl (meth)acrylate, ethyl (meth)acrylate, propyl (meth)acrylate, butyl (meth)acrylate, or 2-ethylhexyl (meth) acrylate], dialkyl fumarate (two alkyl groups being straight-chain alkyl groups, branched alkyl groups, or alicyclic alkyl groups, having a carbon number from 2 to 8), dialkyl maleate (two alkyl groups being straight-chain alkyl groups, branched alkyl groups, or alicyclic alkyl groups, having a carbon number from 2 to 8), poly(meth)allyloxy alkanes (such as diallyloxyethane, triallyloxyethane, tetraallyloxyethane, tetraallyloxypropane, tetraallyloxybutane, or tetramethallyloxyethane), a monomer having a polyalkylene glycol chain and polymeric double bond [such as polyethylene glycol (Mn=300) mono(meth)acrylate, polypropylene glycol (Mn=500) monoacrylate, a 10-mole adduct (meth) acrylate of ethylene oxide (hereinafter "ethylene oxide" being abbreviated as "EO") to methyl alcohol or a 30-mole adduct (meth)acrylate of EO to lauryl alcohol], poly(meth) acrylates {such as poly(meth)acrylate of polyhydric alcohols [such as ethylene glycol di(meth)acrylate, propylene glycol di(meth)acrylate, neopentyl glycol di(meth)acrylate, trimethylol propane tri(meth)acrylate, or polyethylene glycol di(meth)acrylate]}, or the like.

(9-2) Ether Having Carbon Number from 3 to 16 and Having Polymeric Double Bond

Ether having a carbon number from 3 to 16 and having polymeric double bond is preferably, for example, vinyl methyl ether, vinyl ethyl ether, vinyl propyl ether, vinyl butyl ether, vinyl-2-ethyl hexyl ether, vinyl phenyl ether, vinyl-2-methoxy ethyl ether, methoxy butadiene, vinyl-2-butoxyethyl ether, 3,4-dihydro-1,2-pyran, 2-butoxy-2'-vinyloxy diethyl ether, acetoxystyrene, phenoxystyrene, or the like.

(9-3) Ketone Having Carbon Number from 4 to 12 and Having Polymeric Double Bond

Ketone having a carbon number from 4 to 12 and having polymeric double bond is preferably, for example, vinyl methyl ketone, vinyl ethyl ketone, vinyl phenyl ketone, or the like.

(9-4) Sulfur Containing Compound Having Carbon Number from 2 to 16 and Having Polymeric Double Bond A sulfur containing compound having a carbon number from 2 to 16 and having polymeric double bond is preferably, for example, divinyl sulfide, p-vinyl diphenyl sulfide, vinyl ethyl sulfide, vinyl ethyl sulfone, divinyl sulfone, divinylsulfoxide, or the like.

A specific example of a vinyl resin is preferably, for example, a styrene-(meth)acrylic acid ester copolymer, a styrene-butadiene copolymer, a (meth)acrylic acid-(meth) acrylic acid ester copolymer, a styrene-acrylonitrile copolymer, a styrene-maleic acid (maleic anhydride) copolymer, a styrene-(meth)acrylic acid copolymer, a styrene-(meth) acrylic acid-divinylbenzene copolymer, a styrene-styrene sulfonic acid-(meth)acrylic acid ester copolymer, or the like.

The vinyl resin may be a homopolymer or a copolymer of a monomer having polymeric double bond in (1) to (9) above, or it may be a polymerized product of a monomer having polymeric double bond in (1) to (9) above and a monomer (m) having a first molecular chain (k) and having polymeric double bond. The first molecular chain (k) is preferably, for example, a straight-chain or branched hydrocarbon chain having a carbon number from 12 to 27, a fluoro-alkyl chain having a carbon number from 4 to 20, a polydimethylsiloxane chain, or the like. A difference in SP value between the first molecular chain (k) in the monomer (m) and the insulating liquid (L) is preferably 2 or smaller. The "SP value" herein is a numeric value calculated with a Fedors' method [Polym. Eng. Sci. 14(2) 152, (1974)].

Though the monomer (m) having the first molecular chain (k) and polymeric double bond is not particularly limited, it is preferably, for example, monomers (m1) to (m4) below. Two or more of the monomers (m1) to (m4) may be used together.

Monomer (m1) Having Straight-Chain Hydrocarbon Chain Having Carbon Number From 12 to 27 (Preferably From 16 to 25) and Polymeric Double Bond Such a monomer (m1) is preferably, for example, monostraight-chain alkyl (a carbon number of alkyl being from 12 to 27) ester of unsaturated monocarboxylic acid, monostraight-chain alkyl (a carbon number of alkyl being from 12 to 27) ester of unsaturated dicarboxylic acid, or the like. The monomer (m1) is more preferably, for example, a carboxyl group containing vinyl monomer having a carbon number from 3 to 24 such as (meth)acrylic acid, maleic acid, fumaric acid, crotonic acid, itaconic acid, or citraconic acid, or the like. A specific example of the monomer (m1) is, for example, dodecyl (meth)acrylate, stearyl (meth)acrylate, behenyl (meth)acrylate, hexadecyl (meth)acrylate, heptadecyl (meth) acrylate, eicosyl (meth)acrylate, or the like.

Monomer (m2) Having Branched Hydrocarbon Chain Having Carbon Number from 12 to 27 (Preferably from 16 to 25) and Polymeric Double Bond Such a monomer (m2) is preferably, for example, branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, or the like. Unsaturated monocarboxylic acid and unsaturated dicarboxylic acid are preferably, for example, as listed as specific examples of unsaturated monocarboxylic acid and unsaturated dicarboxylic acid with regard to the monomer (m1). A specific example of the monomer (m2) is, for example, 2-decyltetradecyl (meth)acrylate or the like.

Monomer (m3) Having Fluoro-Alkyl Chain Having Carbon Number from 4 to 20 and Polymeric Double Bond Such a monomer (m3) is preferably, for example, perfluoroalkyl (alkyl) (meth)acrylic acid ester or the like expressed with a Chemical Formula (4) below.

$$CH_2{=}CR{-}COO{-}(CH_2)_p{-}(CF_3)_q{-}Z \qquad \text{Chemical Formula (4)}$$

In Chemical Formula (4) above, R represents a hydrogen atom or a methyl group, p represents an integer from 0 to 3, q represents any of 2, 4, 6, 8, 10, and 12, and Z represents a hydrogen atom or a fluorine atom. A specific example of the monomer (m3) is preferably, for example, [(2-perfluoroethyl) ethyl](meth)acrylic acid ester, [(2-perfluorobutyl) ethyl] (meth)acrylic acid ester, [(2-perfluorohexyl) ethyl](meth) acrylic acid ester, [(2-perfluorooctyl) ethyl](meth)acrylic acid ester, [(2-perfluorodecyl) ethyl](meth)acrylic acid ester, [(2-perfluorododecyl) ethyl](meth)acrylic acid ester, or the like.

Monomer (m4) Having Polydimethylsiloxane Chain and Polymeric Double Bond

Such a monomer (m4) is preferably, for example, (meth) acrylic modified silicone or the like expressed with a Chemical Formula (5) below.

$$CH_2{=}CR{-}COO{-}((CH_3)_2SiO)_m{-}Si(CH_3)_3 \quad \text{Chemical Formula (5)}$$

In Chemical Formula (5) above, R represents a hydrogen atom or a methyl group and m is from 15 to 45 on average. A specific example of the monomer (m4) is preferably, for example, modified silicone oil (such as "X-22-174DX", "X-22-2426", or "X-22-2475" manufactured by Shin-Etsu Chemical Co., Ltd.) or the like.

Among the monomers (m1) to (m4), a preferred monomer is the monomer (m1) or the monomer (m2) and a more preferred monomer is the monomer (m2).

A content of the monomer (m) is preferably from 10 to 90 mass %, more preferably from 15 to 80 mass %, and further preferably from 20 to 60 mass %, with respect to a mass of the vinyl resin. So long as the content of the monomer (m) is within the range above, toner particles are less likely to unite with each other.

In a case where a monomer having polymeric double bond in (1) to (9) above, the monomer (m1), and the monomer (m2) are polymerized to make up a vinyl resin, from a point of view of particle size distribution of toner particles (C) and fixability of the toner particles (C), a mass ratio between the monomer (m1) and the monomer (m2) [(m1):(m2)] is preferably from 90:10 to 10:90, more preferably from 80:20 to 20:80, and further preferably from 70:30 to 30:70.

<Polyester Resin>

A polyester resin is preferably, for example, a polycondensed product or the like of polyol and polycarboxylic acid, acid anhydride of polycarboxylic acid, or lower alkyl (a carbon number of an alkyl group being from 1 to 4) ester of polycarboxylic acid. A known polycondensation catalyst or the like can be used for polycondensation reaction.

Polyol is preferably, for example, diol (10), polyol (11) having valence not smaller than 3 (hereinafter abbreviated as "polyol (11)"), or the like.

Polycarboxylic acid is preferably, for example, dicarboxylic acid (12), polycarboxylic acid (13) having valence not smaller than 3 (hereinafter abbreviated as "polycarboxylic acid (13)"), or the like. Acid anhydride of polycarboxylic acid is preferably, for example, acid anhydride of dicarboxylic acid (12), acid anhydride of polycarboxylic acid (13), or the like. Lower alkyl ester of polycarboxylic acid is preferably, for example, lower alkyl ester of dicarboxylic acid (12), lower alkyl ester of polycarboxylic acid (13), or the like.

A ratio between polyol and polycarboxylic acid is not particularly limited. A ratio between polyol and polycarboxylic acid should only be set such that an equivalent ratio between a hydroxyl group [OH] and a carboxyl group [COOH]([OH]/[COOH]) is set preferably to 2/1 to 1/5, more preferably to 1.5/1 to 1/4, and further preferably to 1.3/1 to 1/3.

Diol (10) is preferably, for example, alkylene glycol having a carbon number from 2 to 30 (such as ethylene glycol, 1,2-propylene glycol, 1,3-propylene glycol, 1,4-butanediol, 1,6-hexanediol, octanediol, decanediol, dodecanediol, tetradecanediol, neopentylglycol, or 2,2-diethyl-1,3-propanediol), alkylene ether glycol having Mn=106 to 10000 (such as diethylene glycol, triethylene glycol, dipropylene glycol, polyethylene glycol, polypropylene glycol, or polytetramethylene ether glycol), alicyclic diol having a carbon number from 6 to 24 (such as 1,4-cyclohexanedimethanol or hydrogenated bisphenol A), an adduct (the number of added moles being from 2 to 100) of alkylene oxide (hereinafter "alkylene oxide" being abbreviated as "AO") to alicyclic diol above having Mn=100 to 10000 (such as a 10-mole adduct of EO to 1,4-cyclohexanedimethanol), an adduct (the number of added moles being from 2 to 100) of AO [such as EO, propylene oxide (hereinafter abbreviated as "PO"), or butylene oxide] to bisphenols having a carbon number from 15 to 30 (such as bisphenol A, bisphenol F, or bisphenol S), an adduct of AO to polyphenol having a carbon number from 12 to 24 (such as catechol, hydroquinone, or resorcin) (such as a 2 to 4-mole adduct of EO to bisphenol A or a 2 to 4-mole adduct of PO to bisphenol A), polylactonediol having a weight average molecular weight (hereinafter abbreviated as "Mw")= 100 to 5000 (such as poly-s-caprolactonediol), polybutadienediol having Mw=1000 to 20000, or the like.

Among these, as diol (10), alkylene glycol or an adduct of AO to bisphenols is preferred and an adduct alone of AO to bisphenols or a mixture of an adduct of AO to bisphenols and alkylene glycol is more preferred.

Polyol (11) is preferably, for example, aliphatic polyhydric alcohol having valence not smaller than 3 and having a carbon number from 3 to 10 (such as glycerol, trimethylolethane, trimethylolpropane, pentaerythritol, sorbitan, or sorbitol), an adduct (the number of added moles being from 2 to 100) of AO (having a carbon number from 2 to 4) to trisphenol having a carbon number from 25 to 50 (such as a 2 to 4-mole adduct of EO to trisphenol or a 2 to 4-mole adduct of PO to trisphenol polyamide), an adduct (the number of added moles being from 2 to 100) of AO (having a carbon number from 2 to 4) to a novolac resin (such as phenol novolac or cresol novolac) having n=3 to 50 (such as a 2-mole adduct of PO to phenol novolac or a 4-mole adduct of EO to phenol novolac), an adduct (the number of added moles being from 2 to 100) of AO (having a carbon number from 2 to 4) to polyphenol having a carbon number from 6 to 30 (such as pyrogallol, phloroglucinol, or 1,2,4-benzenetriol) (such as a 4-mole adduct of EO to pyrogallol), acrylic polyol having n=20 to 2000 {such as a copolymer of hydroxyethyl (meth)acrylate and a monomer having other polymeric double bond [such as styrene, (meth)acrylic acid, or (meth)acrylic acid ester]}, or the like.

Among these, as polyol (11), aliphatic polyhydric alcohol or an adduct of AO to a novolac resin is preferred, and an adduct of AO to a novolac resin is more preferred.

Dicarboxylic acid (12) is preferably, for example, alkane dicarboxylic acid having a carbon number from 4 to 32 (such as succinic acid, adipic acid, sebacic acid, azelaic acid, dodecane dicarboxylic acid, or octadecane dicarboxylic acid), alkene dicarboxylic acid having a carbon number from 4 to 32 (such as maleic acid, fumaric acid, citraconic acid, or mesaconic acid), branched alkene dicarboxylic acid having a carbon number from 8 to 40 [such as dimer acid or alkenyl succinic acid (such as dodecenyl succinic acid, pentadecenyl succinic acid, or octadecenyl succinic acid)], branched alkane dicarboxylic acid having a carbon number from 12 to 40 [such as alkyl succinic acid (such as decyl succinic acid, dodecyl succinic acid, or octadecyl succinic acid)], aromatic dicarboxylic acid having a carbon number from 8 to 20 (such as phthalic acid, isophthalic acid, terephthalic acid, or naphthalene dicarboxylic acid), or the like.

Among these, as dicarboxylic acid (12), alkene dicarboxylic acid or aromatic dicarboxylic acid is preferred, and aromatic dicarboxylic acid is more preferred.

Polycarboxylic acid (13) is preferably, for example, aromatic polycarboxylic acid having a carbon number from 9 to 20 (such as trimellitic acid or pyromellitic acid) or the like.

The acid anhydride above is preferably, for example, trimellitic anhydride, pyromellitic anhydride, or the like. The lower alkyl ester above is preferably, for example, methyl ester, ethyl ester, isopropyl ester, or the like.

<Polyurethane Resin>

A polyurethane resin is preferably, for example, a polyadduct of polyisocyanate (14) and an active hydrogen containing compound {for example, at least one of water, polyol [such as diol (10) (including diol having a functional group other than a hydroxyl group) or polyol (11)], polycarboxylic acid [such as dicarboxylic acid (12) or polycarboxylic acid (13)], polyester polyol obtained by polycondensation between polyol and polycarboxylic acid, a ring-opening polymer of lactone having a carbon number from 6 to 12, polyamine (15), and polythiol (16)}. A polyurethane resin may be, for example, an amino group containing polyurethane resin or the like, obtained by causing a terminal isocyanate group prepolymer resulting from reaction between polyisocyanate (14) and the active hydrogen containing compound above to react with primary and/or secondary monoamine(s) (17) in parts equal to an isocyanate group of the terminal isocyanate group prepolymer. A content of a carboxyl group in the polyurethane resin is preferably from 0.1 to 10 mass %.

Polyisocyanate (14) is preferably, for example: aromatic polyisocyanate having a carbon number from 6 to 20 (except for carbon in an NCO group; hereinafter to be similarly understood in <Polyurethane Resin>) or aliphatic polyisocyanate having a carbon number from 2 to 18, a modified product of these polyisocyanates (such as a modified product including a urethane group, a carbodiimide group, an allophanate group, a urea group, a biuret group, a uretdione group, a uretonimine group, an isocyanurate group, an oxazolidone group, or the like), or the like. Two or more of these may be used together.

Aromatic polyisocyanate is preferably, for example, 1,3- or 1,4-phenylene diisocyanate, 2,4- or 2,6-tolylene diisocyanate (hereinafter abbreviated as "TDI"), crude TDI, m- or p-xylylene diisocyanate, α,α,α',α'-tetramethylxylylene diisocyanate, 2,4'- or 4,4'-diphenylmethane diisocyanate (hereinafter abbreviated as "MDI"), crude MDI {such as a phosgenated product of crude diaminophenylmethane [such as a condensed product of formaldehyde and aromatic amine (one type may be used or two or more types may be used together) or a mixture of diaminodiphenylmethane and a small amount (for example, 5 to 20 mass %) of polyamine having three or more amine groups] or polyallyl polyisocyanate}, 1,5-naphtylene diisocyanate, 4,4',4"-triphenylmethane triisocyanate, m- or p-isocyanatophenylsulfonyl isocyanate, or the like. Two or more of these may be used together.

Aliphatic polyisocyanate is preferably, for example, chain aliphatic polyisocyanate, cyclic aliphatic polyisocyanate, or the like.

Chain aliphatic polyisocyanate is preferably, for example, ethylene diisocyanate, tetramethylene diisocyanate, hexamethylene diisocyanate (hereinafter abbreviated as "HDI"), dodecamethylene diisocyanate, 1,6,11-undecane triisocyanate, 2,2,4-trimethyl hexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, or the like. Two or more of these may be used together.

Cyclic aliphatic polyisocyanate is preferably, for example, isophoron diisocyanate (hereinafter abbreviated as "IPDI"), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, or the like. Two or more of these may be used together.

A modified product of polyisocyanate is preferably, for example, a polyisocyanate compound including at least one of a urethane group, a carbodiimide group, an allophanate group, a urea group, a biuret group, a uretdione group, a uretonimine group, an isocyanurate group, and an oxazolidone group, or the like. The modified product of polyisocyanate is preferably, for example, modified MDI (such as urethane-modified MDI, carbodiimide-modified MDI, or trihydrocarbyl-phosphate-modified MDI), urethane-modified TDI, use of two or more types of these [such as use of modified MDI and urethane-modified TDI (such as an isocyanate containing prepolymer) as combined], or the like.

Among these, as polyisocyanate (14), aromatic polyisocyanate having a carbon number from 6 to 15 or aliphatic polyisocyanate having a carbon number from 4 to 15 is preferred. TDI, MDI, HDI, hydrogenated MDI, or IPDI is more preferred.

Polyamine (15) is preferably, for example, aliphatic polyamine having a carbon number from 2 to 18, aromatic polyamine (having a carbon number, for example, from 6 to 20), or the like.

Aliphatic polyamine having a carbon number from 2 to 18 is preferably, for example, chain aliphatic polyamine, an alkyl (having a carbon number from 1 to 4) substitute of chain aliphatic polyamine, a hydroxyalkyl (having a carbon number from 2 to 4) substitute of chain aliphatic polyamine, cyclic aliphatic polyamine, or the like.

Chain aliphatic polyamine is preferably, for example, alkylene diamine having a carbon number from 2 to 12 (such as ethylene diamine, propylene diamine, trimethylene diamine, tetramethylene diamine, or hexamethylene diamine), polyalkylene (having a carbon number from 2 to 6) polyamine [such as diethylene triamine, iminobispropylamine, bis(hexamethylene)triamine, triethylenetetramine, tetraethylenepentamine, or pentaethylenehexamine], or the like.

The alkyl (having a carbon number from 1 to 4) substitute of chain aliphatic polyamine or the hydroxyalkyl (having a carbon number from 2 to 4) substitute of chain aliphatic polyamine is preferably, for example, dialkyl (having a carbon number from 1 to 3) aminopropyl amine, trimethyl hexamethylene diamine, aminoethyl ethanol amine, 2,5-dimethyl-2,5-hexamethylene diamine, methyliminobispropylamine, or the like.

Cyclic aliphatic polyamine is preferably, for example, alicyclic polyamine having a carbon number from 4 to 15 [such as 1,3-diaminocyclohexane, isophoron diamine, menthene diamine, 4,4'-methylene dicyclohexane diamine (hydrogenated methylenedianiline), or 3,9-bis(3-aminopropyl)-2,4,8,10-tetraoxaspiro [5,5]undecane], heterocyclic polyamine having a carbon number from 4 to 15 [such as piperazine, N-aminoethylpiperazine, 1,4-diaminoethylpiperazine, or 1,4-bis(2-amino-2-methylpropyl) piperazine], or the like.

Aromatic polyamine (having a carbon number from 6 to 20) is preferably, for example, non-substituted aromatic polyamine, aromatic polyamine having an alkyl group (for example, an alkyl group having a carbon number from 1 to 4, such as a methyl group, an ethyl group, an n-propyl group, an isopropyl group, or a butyl group), aromatic polyamine having an electron-withdrawing group (such as halogen atoms such as Cl, Br, I, or F, an alkoxy group such as a methoxy group or an ethoxy group, or a nitro group), aromatic polyamine having a secondary amino group, or the like.

Non-substituted aromatic polyamine is preferably, for example, 1,2-, 1,3-, or 1,4-phenylene diamine, 2,4'- or 4,4'-diphenyl methane diamine, crude diphenyl methane diamine (such as polyphenyl polymethylene polyamine), diaminodiphenyl sulfone, benzidine, thiodianiline, bis(3,4-diaminophenyl) sulfone, 2,6-diaminopyridine, m-aminobenzyl amine, triphenylmethane-4,4',4"-triamine, naphtylene diamine, or the like. Two or more of these may be used together.

Aromatic polyamine having an alkyl group (for example, an alkyl group having a carbon number from 1 to 4, such as a methyl group, an ethyl group, an n-propyl group, an isopropyl group, or a butyl group) is preferably, for example, 2,4- or 2,6-tolylene diamine, crude tolylene diamine, diethyl tolylene diamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-diethyl-2,4-diaminobenzene, 1,3-dimethyl-2,6-diaminobenzene, 1,4-diethyl-2,5-diamino benzene, 1,4-diisopropyl-2,5-diaminobenzene, 1,4-dibutyl-2,5-diaminobenzene, 2,4-diaminomesitylene, 1,3,5-triethyl-2,4-diaminobenzene, 1,3,5-triisopropyl-2,4-diaminobenzene, 1-methyl-3,5-diethyl-2,4-diaminobenzene, 1-methyl-3,5-diethyl-2,6-diaminobenzene, 2,3-dimethyl-1,4-diaminonaphthalene, 2,6-dimethyl-1,5-diaminonaphthalene, 2,6-diisopropyl-1,5-diaminonaphthalene, 2,6-dibutyl-1,5-diaminonaphthalene, 3,3',5,5'-tetramethylbenzidine, 3,3',5,5'-tetraisopropylbenzidine, 3,3',5,5'-tetramethyl-4,4'-diaminodiphenylmethane, 3,3',5,5'-tetraethyl-4,4'-diaminodiphenylmethane, 3,3',5,5'-tetraisopropyl-4,4'-diaminodiphenylmethane, 3,3',5,5'-tetrabutyl-4,4'-diaminodiphenylmethane, 3,5-diethyl-3'-methyl-2',4-diaminodiphenylmethane, 3,5-diisopropyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraisopropyl-4,4'-diaminobenzophenone, 3,3',5,5'-tetraethyl-4,4'-diaminodiphenyl ether, 3,3',5,5'-tetraisopropyl-4,4'-diaminodiphenyl sulfone, or the like. Two or more of these may be used together.

Aromatic polyamine having an electron-withdrawing group (such as halogen atoms such as Cl, Br, I, or F, an alkoxy group such as a methoxy group or an ethoxy group, or a nitro group) is preferably, for example: methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl) oxide, bis(4-amino-2-chlorophenyl) propane, bis(4-amino-2-chlorophenyl) sulfone, bis(4-amino-3-methoxy phenyl)decane, bis(4-aminophenyl)sulfide, bis(4-aminophenyl)telluride, bis(4-aminophenyl)selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline), 4-aminophenyl-2-chloroaniline, or the like.

Aromatic polyamine having a secondary amino group is preferably, for example, polyamine in which a part or entirety of —$NH_2$ in non-substituted aromatic polyamine above, aromatic polyamine having an alkyl group, or aromatic polyamine having an electron-withdrawing group has been substituted with —NH—R' (R' representing an alkyl group, and for example, representing a lower alkyl group such as a methyl group or an ethyl group having a carbon number from 1 to 4) [such as 4,4'-di(methylamino) diphenylmethane or 1-methyl-2-methylamino-4-aminobenzene], or the like. Aromatic polyamine having a secondary amino group may be, for example, low-molecular-weight polyamide polyamine obtained by condensation of dicarboxylic acid (such as a dimer acid) and an excess (at least 2 moles per 1 mole of acid) of polyamines (such as alkylenediamine above or polyalkylenepolyamine), polyamide polyamine, polyether polyamine, a hydride of a cyanoethylated product of polyether polyol (such as polyalkylene glycol), or the like.

Polythiol (16) is preferably, for example, alkane dithiol having a carbon number from 2 to 36 (such as ethanedithiol, 1,4-butanedithiol, or 1,6-hexanedithiol), or the like.

Primary and/or secondary monoamine(s) (17) is/are preferably, for example, alkylamine having a carbon number from 2 to 24 (such as ethylamine, n-butyl amine, isobutylamine, diethylamine, or n-butyl-n-dodecyl amine), or the like.

<Epoxy Resin>

An epoxy resin is preferably, for example, a ring-opening polymerized product of polyepoxide (18), a polyadduct of polyepoxide (18) and an active hydrogen containing compound [such as water, diol (10), dicarboxylic acid (12), polyamine (15), or polythiol (16)], a cured product of polyepoxide (18) and acid anhydride of dicarboxylic acid (12), or the like.

Polyepoxide (18) is not particularly limited so long as it has two or more epoxy groups in a molecule. From a point of view of mechanical characteristics of a cured product, a substance having 2 epoxy groups in a molecule is preferred as polyepoxide (18). An epoxy equivalent (a molecular weight per one epoxy group) of polyepoxide (18) is preferably from 65 to 1000 and more preferably from 90 to 500. When an epoxy equivalent is 1000 or smaller, a cross-linked structure becomes dense so that such physical properties as water resistance, chemical resistance, and mechanical strength of the cured product improve. On the other hand, when an epoxy equivalent is smaller than 65, synthesis of polyepoxide (18) may become difficult.

Polyepoxide (18) is preferably, for example, an aromatic polyepoxy compound, an aliphatic polyepoxy compound, or the like.

An aromatic polyepoxy compound is preferably, for example, glycidyl ether of polyhydric phenol, glycidyl ester of aromatic polyvalent carboxylic acid, glycidyl aromatic polyamine, a glycidylated product of aminophenol, or the like.

The glycidyl ether of polyhydric phenol is preferably, for example, bisphenol F diglycidyl ether, bisphenol A diglycidyl ether, bisphenol B diglycidyl ether, bisphenol AD diglycidyl ether, bisphenol S diglycidyl ether, halogenated bisphenol A diglycidyl, tetrachloro bisphenol A diglycidyl ether, catechin diglycidyl ether, resorcinol diglycidyl ether, hydroquinone diglycidyl ether, pyrogallol triglycidyl ether, 1,5-dihydroxynaphthaline diglycidyl ether, dihydroxybiphenyl diglycidyl ether, octachloro-4,4'-dihydroxybiphenyl diglycidyl ether, tetramethylbiphenyl diglycidyl ether, dihydroxynaphthyl cresol triglycidyl ether, tris(hydroxyphenyl) methane triglycidyl ether, dinaphthyl triol triglycidyl ether, tetrakis(4-hydroxyphenyl) ethane tetraglycidyl ether, p-glycidyl phenyl dimethyl tolyl bisphenol A glycidyl ether, trismethyl-t-butyl-butylhydroxy methane triglycidyl ether, 9,9'-bis(4-hidroxyphenyl) fluorene diglycidyl ether, 4,4'-oxybis(1,4-phenylethyl) tetracresol glycidyl ether, 4,4'-oxybis(1,4-phenylethyl)

phenyl glycidyl ether, bis(dihydroxynaphthalene) tetra glycidyl ether, glycidyl ether of phenol, glycidyl ether of a cresol novolac resin, glycidyl ether of a limonene phenol novolac resin, diglycidyl ether obtained from reaction between 2 moles of bisphenol A and 3 moles of epichlorohydrin, or the like. Glycidyl ether of polyhydric phenol may be, for example, polyglycidyl ether of polyphenol obtained from condensation reaction between phenol and glyoxal, glutaraldehyde, or formaldehyde, or may be polyglycidyl ether of polyphenol obtained from condensation reaction between resorcin and acetone.

The glycidyl ester of aromatic polyvalent carboxylic acid is preferably, for example, phthalic acid diglycidyl ester, isophthalic acid diglycidyl ester, terephthalic acid diglycidyl ester, or the like.

Glycidyl aromatic polyamine is preferably, for example, N,N-diglycidyl aniline, N,N,N',N'-tetraglycidyl xylylene diamine, N,N,N',N'-tetraglycidyl diphenylmethane diamine, or the like.

Other than the compounds listed above, an aromatic polyepoxy compound may be triglycidyl ether of p-aminophenol (an example of a glycidylated product of aminophenol), a diglycidyl urethane compound obtained from reaction between tolylene diisocyanate or diphenylmethane diisocyanate and glycidol, a glicidyl group containing polyurethane (pre)polymer obtained from reaction between tolylene diisocyanate or diphenylmethane diisocyanate, glycidol, and polyol, diglycidyl ether of an adduct of AO to bisphenol A, or the like.

An aliphatic polyepoxy compound is preferably, for example, a chain aliphatic polyepoxy compound, a cyclic aliphatic polyepoxy compound, or the like. The aliphatic polyepoxy compound may be a copolymer of diglycidyl ether and glycidyl (meth)acrylate.

A chain aliphatic polyepoxy compound is preferably, for example, polyglycidyl ether of polyhydric aliphatic alcohol, polyglycidyl ester of polyvalent fatty acid, glycidyl aliphatic amine, or the like.

The polyglycidyl ether of polyhydric aliphatic alcohol is preferably, for example, ethylene glycol diglycidyl ether, propylene glycol diglycidyl ether, tetramethylene glycol diglycidyl ether, 1,6-hexanediol diglycidyl ether, polyethylene glycol diglycidyl ether, polypropylene glycol diglycidyl ether, polytetramethylene glycol diglycidyl ether, neopentyl glycol diglycidyl ether, trimethylolpropane polyglycidyl ether, glycerol polyglycidyl ether, pentaerythritol polyglycidyl ether, sorbitol polyglycidyl ether, polyglycerol polyglycidyl ether, or the like.

The polyglycidyl ester of polyvalent fatty acid is preferably, for example, diglycidyl oxalate, diglycidyl maleate, diglycidyl succinate, diglycidyl glutarate, diglycidyl adipate, diglycidyl pimelate, or the like.

Glycidyl aliphatic amine is preferably, for example, N,N,N',N'-tetraglycidylhexamethylene diamine or the like.

A cyclic aliphatic polyepoxy compound is preferably, for example, trisglycidyl melamine, vinyl cyclohexene dioxide, limonene dioxide, dicyclopentadiene dioxide, bis(2,3-epoxy cyclopentyl) ether, ethylene glycol bisepoxy dicyclopentyl ether, 3,4-epoxy-6-methylcyclohexylmethyl-3',4'-epoxy-6'-methylcyclohexane carboxylate, bis(3,4-epoxy-6-methylcyclohexylmethyl) adipate, bis(3,4-epoxy-6-methylcyclohexylmethyl) butylamine, dimer acid diglycidyl ester, or the like. A cyclic aliphatic polyepoxy compound may be a hydrogenated product of the aromatic polyepoxy compound above.

<Polyamide Resin>

A polyamide resin is preferably, for example, a ring-opening polymer of lactam, a polycondensed product of aminocarboxylic acid, a polycondensed product of polycarboxylic acid and polyamine, or the like.

<Polyimide Resin>

A polyimide resin is preferably, for example, an aliphatic polyimide resin (such as a condensed polymer obtained from aliphatic carboxylic dianhydride and aliphatic diamine), an aromatic polyimide resin (such as a condensed polymer obtained from aromatic carboxylic dianhydride and aliphatic diamine or aromatic diamine), or the like.

<Silicon Resin>

A silicon resin is preferably, for example, a compound having in a molecular chain, at least one of silicon-silicon bond, silicon-carbon bond, siloxane bond, or silicon-nitrogen bond (such as polysiloxane, polycarbosilane, or polysilazane) or the like.

<Phenol Resin>

A phenol resin is preferably, for example, a condensed polymer obtained from phenols (such as phenol, cresol, nonyl phenol, lignin, resorcin, or catechol) and aldehydes (such as formaldehyde, acetaldehyde, or furfural), or the like.

<Melamine Resin>

A melamine resin is preferably, for example, a condensed product obtained from melamine and formaldehyde, or the like.

<Urea Resin>

A urea resin is preferably, for example, a polycondensed product obtained from urea and formaldehyde, or the like.

<Aniline Resin>

An aniline resin is preferably, for example, a product obtained from reaction between aniline and aldehydes in an acidic condition, or the like.

<Ionomer Resin>

An ionomer resin is preferably, for example, a copolymer of a monomer having polymeric double bond (such as an a-olefin based monomer or a styrene based monomer) and α,β-unsaturated carboxylic acid (such as acrylic acid, methacrylic acid, maleic acid, itaconic acid, maleic acid monomethyl ester, maleic anhydride, or maleic acid monoethyl ester), in which a part or entirety of carboxylic acid is carboxylate (such as potassium salt, sodium salt, magnesium salt, or calcium salt), or the like.

<Polycarbonate Resin>

A polycarbonate resin is preferably, for example, a condensed polymer of bisphenols (such as bisphenol A, bisphenol F, or bisphenol S) and phosgene, diester carbonate, or the like, or the like.

<Crystallinity•Non-Crystallinity>

The shell resin (a) may be a crystalline resin (a1), a non-crystalline resin (a2), or combination of the crystalline resin (a1) and the non-crystalline resin (a2). From a point of view of fixability of toner particles (C), the shell resin (a) is preferably the crystalline resin (a1).

"Crystallinity" herein means that a ratio between a softening point of a resin (hereinafter abbreviated as "Tm") and a maximum peak temperature (hereinafter abbreviated as "Ta") of heat of fusion of the resin (Tm/Ta) is not lower than 0.8 and not higher than 1.55 and that a result obtained in differential scanning calorimetry (DSC) does not show stepwise change in amount of heat absorption but has a clear heat absorption peak. "Non-crystallinity" herein means that a ratio between Tm and Ta (Tm/Ta) is higher than 1.55. Tm and Ta can be measured with a method below.

A flow tester (capillary rheometer) (such as "CFT-500D" manufactured by Shimadzu Corporation) can be used to measure Tm. Specifically, while 1 g of a measurement sample is heated at a temperature increase rate of 6° C./min., a plunger applies load of 1.96 MPa to the measurement sample to thereby extrude the measurement sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (such as "DSC210" manufactured by Seiko Instruments, Inc.) can be used to measure Ta. Specifically, a sample to be used for measurement of Ta is initially subjected to pre-treatment. After the sample is molten at 130° C., a temperature is lowered from 130° C. to 70° C. at a rate of 1.0° C./min., and thereafter a temperature is lowered from 70° C. to 10° C. at a rate of 0.5° C./min. Then, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'−10)° C., it is in turn stored for 6 hours at (Ta'−15)° C.

Then, with the DSC method, the sample subjected to the pre-treatment above is cooled to 0° C. at a temperature lowering rate of 10° C./min., a temperature is raised at a temperature increase rate of 20° C./min., change in heat absorption and generation is measured, and relation between an "amount of heat absorption and generation" and a "temperature" is plotted in a graph. A temperature at which an amount of heat absorption attains to a maximum value is defined as a maximum peak temperature (Ta) of heat of fusion.

<Heat of Melting>

In a case where the shell resin (a) is the crystalline resin (a1), the shell resin (a) desirably satisfies a condition that heat of fusion with DSC of the shell resin (a) satisfies Equations (3) to (4) below:

$$5 \leq H1 \leq 70 \quad \text{Equation (3)}$$

$$0.2 \leq H2/H1 \leq 1.0 \quad \text{Equation (4)}$$

where H1 represents heat of fusion (J/g) at the time of initial temperature increase with DSC and H2 represents heat of fusion (J/g) at the time of second temperature increase with DSC.

H1 is an index of a rate of melting of the shell resin (a). In general, since a resin having heat of fusion has sharp-melting capability, it can be molten with less energy. Therefore, by selecting a resin having heat of fusion as the shell resin (a), energy required at the time of fixation can be lowered. Therefore, a resin having heat of fusion is preferably selected as the shell resin (a). If heat of fusion which the resin has is too great, it may be difficult to sufficiently melt the resin. Preferably, relation of $6 \leq H1 \leq 65$ is satisfied and more preferably relation of $7 \leq H1 \leq 65$ is satisfied.

H2/H1 in Equation (4) above is an index of a rate of crystallization of the shell resin (a). In general, in a case where particles made of a resin (resin particles) are used as they are molten and thereafter cooled, if a non-crystallized portion is present in crystal components in the resin particles, such a disadvantage that a resistance value of the resin particles is lowered or the resin particles are plasticized is caused. If such a disadvantage is caused, performance of the resin particles obtained by cooling may be different from performance as originally designed. From the foregoing, it is necessary to quickly crystallize crystal components in the resin particles and to avoid influence on performance of the resin particles. H2/H1 is more preferably not lower than 0.3 and more preferably not lower than 0.4. If a rate of crystallization of the shell resin (a) is high, H2/H1 is close to 1.0 and hence H2/H1 preferably takes a value close to 1.0.

H2/H1 in Equation (4) above does not exceed 1.0 theoretically, however, a value actually measured with DSC may exceed 1.0. Even a case where a value (H2/H1) actually measured with DSC exceeds 1.0 is also assumed to satisfy Equation (4) above.

H1 and H2 can be measured in compliance with "testing methods for heat of transitions of plastics" under JIS-K7122 (1987). Specifically, initially, 5 mg of the shell resin (a) is taken and introduced in an aluminum pan. With a differential scanning calorimetry apparatus (such as "RDC220" manufactured by SII Nano Technology Inc. or "DSC20" of Seiko Instruments Inc.) and with a rate of temperature increase being set to 10° C./min., a temperature at a heat absorption peak of the shell resin (a) owing to melting (melting point) is measured and an area S1 of a heat absorption peak is found. H1 can be calculated from found area S1 of the heat absorption peak. After H1 is calculated, a rate of cooling is set to 90° C./min., thereafter cooling to 0° C. is carried out, a rate of temperature increase is set to 10° C./min., a temperature at a heat absorption peak of the shell resin (a) owing to melting (melting point) is measured, and an area S2 of a heat absorption peak is found. H2 can be calculated from found area S2 of the heat absorption peak.

<Melting Point>

The shell resin (a) has a melting point preferably from 0 to 220° C., more preferably from 30 to 200° C., and further preferably from 40 to 80° C. From a point of view of particle size distribution of toner particles (C), powder fluidity of the liquid developer (X), heat-resistant storage stability of the liquid developer (X), resistance to stress of the liquid developer (X), and the like, the shell resin (a) has a melting point preferably not lower than a temperature at the time of manufacturing of the liquid developer (X). If a melting point of the shell resin is lower than a temperature at the time of manufacturing of the liquid developer, toner particles may unite with each other and the toner particles may break. In addition, a width of distribution in particle size distribution of the toner particles may be great. In other words, variation in particle size of toner particles may be great.

A melting point is herein measured with the use of a differential scanning calorimetry apparatus (such as "DSC20" or "SSC/580" manufactured by Seiko Instruments, Inc.) in compliance with a method defined under ASTM D3418-82.

<Mn and Mw>

Mn [obtained from measurement with gel permeation chromatography (hereinafter abbreviated as "GPC")] of the shell resin (a) is preferably from 100 to 5000000, preferably from 200 to 500000, and further preferably from 500 to 500000.

Mn and Mw of a resin (except for a polyurethane resin) herein are measured under conditions below, with the use of GPC, with regard to a soluble content of tetrahydrofuran (hereinafter abbreviated as "THF").

Measurement Apparatus: "HLC-8120" manufactured by Tosoh Corporation

Column: "TSKgel GMHXL" (two) manufactured by Tosoh Corporation and "TSKgel Multipore HXL-M" (one) manufactured by Tosoh Corporation Sample Solution: 0.25 mass % of THF solution Amount of Injection of Sample Solution into Column: 100 μl Flow Rate: 1 ml/min.

Measurement Temperature: 40° C.

Detection Apparatus: Refraction index detector

Reference Material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

In a case where a polyurethane resin is adopted as the shell resin (a), Mn and Mw are measured under conditions below, with the use of GPC.

Measurement Apparatus: "HLC-8220GPC" manufactured by Tosoh Corporation

Column: "Guardcolumn α" (one) and "TSKgel α-M" (one)

Sample Solution: 0.125 mass % of dimethylformamide solution

Amount of Injection of Sample Solution into Column: 100μl

Flow Rate: 1 ml/min.

Measurement Temperature: 40° C.

Detection Apparatus: Refraction index detector

Reference Material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

<SP Value>

The shell resin (a) has an SP value preferably from 7 to 18 $(cal/cm^3)^{1/2}$ and more preferably from 8 to 14 $(cal/cm^3)^{1/2}$.

<Core Resin (b)>

Mn of the core resin (b) and a urethane group concentration (mass %) in the core resin (b) satisfy Equations (1) to (2) below:

$$-0.00003x+2.03 \leq y \leq -0.00003x+6.95 \quad \text{Equation (1)}$$

$$10000 \leq x \leq 60000 \quad \text{Equation (2)}$$

where x represents Mn of the core resin (b) and y represents a urethane group concentration (mass %) in the core resin (b). Urethane group concentration y (mass %) in the core resin (b) is calculated in accordance with an Equation (5) below. [Mass of urethane group in core resin (b)] in Equation (5) below is calculated, assuming that a urethane group (—NH—CO—O—) has a molecular weight of 59.

$$y=[\text{Mass of urethane group in core resin } (b)]/[\text{Mass of core resin } (b)]\times 100 \quad \text{Equation (5)}$$

Mn of the core resin (b) (that is, x in Equations (1) to (2) above) is an index for melt viscosity of the core resin (b). Mn of the core resin (b) satisfying Equation (2) above means that melt viscosity of the core resin (b) has been optimized. Therefore, by employing the liquid developer (X) according to the present embodiment as a liquid developer to be used for electrophotography, electrostatic recording, electrostatic printing, or the like, fixability of the toner particles (C) is improved. Therefore, glossiness of an image is improved.

On the other hand, when Mn of the core resin exceeds 60000, melt viscosity of the core resin cannot sufficiently be low. Therefore, fixability of the toner particles lowers and hence glossiness of an image is lowered. In addition, when Mn of the core resin exceeds 60000, a particle size of the toner particles is greater. Therefore, if a liquid developer containing the core resin having Mn exceeding 60000 is employed as a liquid developer to be used for electrophotography, electrostatic recording, electrostatic printing, or the like, image quality is lowered. When Mn of the core resin is lower than 10000, melt viscosity of the core resin is too low. Therefore, it is difficult to maintain elasticity of the core resin in a high-temperature region, and hence hot offset takes place. Therefore, glossiness of an image lowers. Additionally, image density also lowers.

A urethane group concentration in the core resin (b) (that is, y in Equation (1) above) is an index of elasticity of the core resin (b). In a case where the liquid developer (X) according to the present embodiment is employed as the liquid developer to be used for electrophotography, electrostatic recording, electrostatic printing, or the like, by employing a resin of which melt viscosity is low and of which urethane group concentration has been optimized, that is, by employing a resin satisfying Equations (1) to (2) above, the resin can be provided with elasticity in a high-temperature region. Therefore, since a region of a fixation temperature is greater, fixability of toner particles (C) is improved. Thus, glossiness of an image is improved.

On the other hand, if a urethane group concentration in the core resin becomes too high, that is, if a urethane group concentration in the core resin exceeds a numeric value on the right side of Equation (1) above, melt viscosity of the core resin becomes higher. Therefore, fixability of the toner particles lowers and hence glossiness of an image lowers. When a urethane group concentration in the core resin is too low, that is, when a urethane group concentration in the core resin is lower than a numeric value on the left side of Equation (1) above, melt viscosity of the core resin is too low. Therefore, it is difficult to maintain elasticity of the core resin in a high-temperature region and hence hot offset occurs. Therefore, glossiness of an image lowers. Additionally, image density also lowers.

A melting point, a glass transition point (hereinafter abbreviated as "Tg"), and an SP value of the core resin (b) are preferably adjusted as appropriate in accordance with applications of the liquid developer (X). For example, in a case where the liquid developer (X) according to the present embodiment is employed as a liquid developer to be used for electrophotography, electrostatic recording, electrostatic printing, or the like, the core resin (b) has a melting point preferably from 20 to 300° C. and more preferably from 80 to 250° C. The core resin (b) has Tg preferably from 20 to 200° C. and more preferably from 40 to 150° C. The core resin (b) has an SP value preferably from 8 to 16 $(cal/cm^3)^{1/2}$ and more preferably from 9 to 14 $(cal/cm^3)^{1/2}$.

The melting point is measured in accordance with the method described in <Melting Point> above. Tg may be measured with the DSC method or with a flow tester. In a case where Tg is measured with the DSC method, for example, a differential scanning calorimetry apparatus ("DSC20", "SSC/580", "DSC6200", or the like manufactured by Seiko Instruments, Inc.) is preferably used to measure Tg in compliance with a method defined under ASTM D3418-82.

In a case where Tg is measured with a flow tester, a flow tester (capillary rheometer) (such as "CFT-500 type" manufactured by Shimadzu Corporation) is preferably employed. One example of measurement conditions of Tg in this case is shown below.

Load: 3 MPa

Rate of Temperature Increase: 3.0° C./min.

Die Diameter: 0.50 mm

Die Length: 10.0 mm

Mn and Mw of the core resin (b) are measured under conditions below, with the use of GPC.

Measurement Apparatus: "HLC-8220GPC" manufactured by Tosoh Corporation

Column: Shodex KF-404HQ and Shodex KF-402HQ (each manufactured by Showa Denko K.K.)

Sample Solution: 0.25 mass % of THF solution

Amount of Injection of THF Solution into Column: 100 μl

Flow Rate: 0.3 ml/min.

Detection Apparatus: RI (refraction index) detector

Calibration Curve: Standard polystyrene

A urethane group concentration in the core resin (b) can be measured, for example, with the use of GCMS. Specifically, the core resin (b) is pyrolized, and then a urethane group concentration in the core resin (b) is calculated based on a ratio of ionic strength detected from the pyrolized core resin (b).

The urethane group concentration in the core resin (b) was herein measured under conditions shown below.

Apparatus: "QP2010" manufactured by Shimadzu Corporation

Column: "UltraALLOY-5" manufactured by Frontier Laboratories Ltd. (inner diameter: 0.25 mm, length: 30 m, thickness: 0.25 μm)

Temperature Increase Condition: Temperature Increase Range: 100° C. to 320° C. (held at 320° C.), Rate of Temperature Increase: 20° C./min.

Pyrolysis of the core resin (b) in measurement of a urethane group concentration in the core resin (b) was herein carried out under conditions shown below.

Apparatus: "PY-2020iD" manufactured by Frontier Laboratories Ltd.

Mass of Sample: 0.1 mg

Heating Temperature: 550° C.

Heating Time Period: 0.5 minute

A specific example of the core resin (b) is not particularly limited so long as it satisfies Equations (1) to (2) above. The core resin (b) may be, for example, polyurethane resins listed in <Polyurethane Resin> above, which satisfy Equations (1) to (2) above. The core resin (b) may be a resin having a resin other than a polyurethane resin (such as a polyester resin) as a basic skeleton and having a urethane group in part, which satisfies Equations (1) to (2) above.

By adjusting as appropriate Mn of a polyester resin which is a source material of a polyurethane resin and a molar ratio between an isocyanate group and a hydroxyl group at the time of manufacturing of the core resin (b), Mn of the core resin (b) and a urethane group concentration in the core resin (b) can be adjusted.

The core resin (b) is preferably a crystalline resin. In a case where the core resin (b) is the crystalline resin, it preferably satisfies Equations (3) to (4) above shown in <Heat of Melting> above.

<Coloring Agent>

The toner particles (C) in the present embodiment contain nigrosine as a coloring agent, and preferably contain both of nigrosine and carbon black as coloring agents. The toner particles (C) in the present embodiment may further contain a dispersant for coloring agent. The toner particles (C) in the present embodiment may further contain at least one of a yellow pigment such as C. I. (color index) Pigment Yellow 12, a magenta pigment such as C. I. Pigment Red 48, and a cyan pigment such as C. I. Pigment Blue 15:1, as a coloring agent.

<Nigrosine>

Nigrosine in the present embodiment is various types of azine-based compounds which can be obtained by subjecting aniline or aniline hydrochloride and nitrobenzene to oxidation-reduction condensation in the presence of such a catalyst as iron chloride. Nigrosine in the present embodiment preferably contains as a main component, an azine-based compound which is a purple-black dye having a skeleton formed by phenazine, phenazine azine, triphenazine oxazine, or the like. Here, a main component refers to a component contained by 50% or more with respect to a total mass of nigrosine contained in the liquid developer (X) according to the present embodiment.

Nigrosine in the present embodiment is preferably, for example, one example of C. 1. Solvent Black 5 or one example of C. 1. Solvent Black 7. Two or more of these may be used together.

C. I. Solvent Black 5 is preferably, for example, a commercially available product under such a trade name as Spirit Black SB, Spirit Black SSBB, Spirit Black AB, Spirit Black ABL, NUBIAN BLACK NH-805, or NUBIAN BLACK NH-815 (each manufactured by Orient Chemical Industries Co., Ltd.).

C. I. Solvent Black 7 is preferably, for example, a commercially available product under such a trade name as Nigrosine Base SA, Nigrosine Base SAP, Nigrosine Base SAPL, Nigrosine Base EE, Nigrosine Base EEL, Nigrosine Base EX, Nigrosine Base EXBP, Special Black EB, NUBIAN BLACK TN-870, NUBIAN BLACK TN-877, NUBIAN BLACK TH-807, NUBIAN BLACK TH-827, or NUBIAN GREY IR-B (each manufactured by Orient Chemical Industries Co., Ltd.).

Other than C. I. Solvent Black 5 and C. I. Solvent Black 7 above, nigrosine in the present embodiment may be a commercially available product under such a trade name as BONTRON N-01, BONTRON N-04, BONTRON N-07, BONTRON N-09, BONTRON N-21, BONTRON N-71, BONTRON N-75, or BONTRON N-79 (each manufactured by Orient Chemical Industries Co., Ltd.).

A content of nigrosine in the toner particles (C) is not lower than 1 mass and not higher than 20 mass % and preferably not lower than 1 mass % and not higher than 15 mass %. Since a crystallization temperature of a crystalline resin can thus be lowered, timing of crystallization of the crystalline resin can be delayed. Since a surface of an image is thus smoothened, glossiness of an image is improved.

When a content of nigrosine in the toner particles is lower than 1 mass %, the effect of lowering in crystallization temperature of a crystalline resin is difficult to achieve. Therefore, since a surface of an image is less likely to become smooth, glossiness of an image is lowered. Alternatively, when a content of nigrosine in the toner particles exceeds 20 mass % as well, it is difficult to further lower a crystallization temperature of a crystalline resin. In addition, transfer performance of the toner particles is lowered and glossiness of an image is conversely lowered.

<Carbon Black>

Carbon black is preferably, for example, thermal black, acetylene black, channel black, furnace black, orchid black, aniline black, carbon black derived from biomass, or the like. Two or more of these may be used together.

As necessary, surface treatment for altering a characteristic of a surface of carbon black is preferably performed. For example, surface treatment for making a surface of carbon black acid can be performed. A method of surface treatment above is preferably conventionally known various methods, and for example, a wet type surface treatment method or a dry type surface treatment method is preferred. The wet type surface treatment method is, for example, a treatment method of immersing carbon black in an acid solution such as an acetic acid solution or a sulfonic acid solution. The dry type surface treatment method may be, for example, an air oxidation method, or a method of brining carbon black in contact with nitric acid, a gas mixture of nitrogen oxide and air, or an oxidizer such as ozone. As such surface treatment is performed on the surface of carbon black, pH of the surface can be adjusted. It is noted that pH of a surface of some commercially available carbon black has already been adjusted.

Carbon black may be, for example, #2400 (pH 2.0), #2400B (pH 2.5), #2650 (pH 3.0), OIL7B (pH 3.0), MA-7 (pH 2.8), MA-100 (pH 3.0), MA-100S (pH 3.5), PCF#10 (pH 7.0), or the like manufactured by Mitsubishi Chemical Corporation, Black Pearls L (pH 2.5), MOGUL-L (pH 2.5), MONARCH 1300 (pH 2.5), MONARCH 1400 (pH 2.5), REGAL 330R (pH 8.5), REGAL 400R (pH 4.0), MONARCH 1100 (pH 7.0), or the like manufactured by Cabot Corporation, or Printex V (pH 3.0), Special Black 4 (pH 3.0), Printex 140V (pH 4.5), or the like manufactured by Degussa. A numeric value in parentheses represents a pH value at a surface of carbon black.

A content of carbon black in the toner particles (C) is not particularly limited. A content of carbon black in the toner particles (C), however, is preferably set such that a total content of nigrosine and carbon black in the toner particles (C) is not lower than 15 mass % and not higher than 50 mass %. Thus, image density is higher. When a total content of nigrosine and carbon black in the toner particles (C) is lower than 15 mass %, image density may be lower. When a total content of nigrosine and carbon black in the toner particles (C) exceeds 50 mass %, transfer performance of the toner particles may be lowered and hence lowering in image density and lowering in glossiness of an image may be caused.

<Dispersant for Coloring Agent>

A dispersant for coloring agent has a function to uniformly disperse a coloring agent in toner particles (C) and it is preferably a basic dispersant. Here, the basic dispersant refers to a dispersant defined below. Namely, 0.5 g of a dispersant for coloring agent and 20 ml of distilled water are introduced in a screw bottle made of glass, the screw bottle is shaken for 30 minutes with the use of a paint shaker, and the resultant product is filtered. PH of a filtrate obtained through filtration is measured with a pH meter (trade name: "D-51" manufactured by Horiba, Ltd.), and a filtrate of which pH is higher than 7 is defined as a basic dispersant. It is noted that a filtrate obtained by filtration, of which pH is lower than 7, is referred to as an acid dispersant.

A type of such a basic dispersant is not particularly limited. For example, a compound (dispersant) having a functional group such as an amino group, an amide group, a pyrrolidone group, an imine group, or a urethane group in a molecule of the dispersant can be exemplified. It is noted that what is called a surfactant having a hydrophilic portion and a hydrophobic portion in a molecule normally falls under the dispersant. Not only the surfactant but also various compounds, however, are employed as the dispersant in the present embodiment, so long as they have a function to disperse a coloring agent.

A commercially available product of such a basic dispersant may be, for example, "Ajisper PB-821" (trade name), "Ajisper PB-822" (trade name), "Ajisper PB-881" (trade name), or the like manufactured by Ajinomoto Fine-Techno Co., Inc., or may be "Solsperse 28000" (trade name), "Solsperse 32000" (trade name), "Solsperse 32500" (trade name), "Solsperse 35100" (trade name), "Solsperse 37500" (trade name), or the like manufactured by Japan Lubrizol Limited.

An amount of addition of such a dispersant for coloring agent is preferably from 1 to 100 mass % and more preferably from 1 to 40 mass % with respect to a coloring agent. When an amount of addition of the dispersant for coloring agent is lower than 1 mass % with respect to the coloring agent, dispersibility of the coloring agent may be insufficient. Therefore, necessary image density may not be achieved or fixation strength may be lowered. If an amount of addition of the dispersant for coloring agent exceeds 100 mass % with respect to the coloring agent, the dispersant for coloring agent in an amount exceeding an amount necessary for dispersing the coloring agent will be added. Therefore, an excess of the dispersant for coloring agent may be dissolved in the insulating liquid, which may adversely affect chargeability, fixation strength, and the like of the toner particles.

One type alone or two or more types in combination may be employed as such a dispersant for coloring agent.

[Physical Properties of Toner Particles]

The toner particles (C) preferably have a volume average particle size not smaller than 0.5 μm and not greater than 5 μm. When the volume average particle size of the toner particles is smaller than 0.5 μm, performance of development of the toner particles on a recording material may lower and deterioration of an image may be caused. In addition, improvement in image density may be difficult to achieve. When the volume average particle size of the toner particles exceeds 5 μm it may be difficult to obtain a high-quality image.

The "volume average particle size" herein can be measured by using, for example, a laser particle size distribution analyzer (such as "LA-920" manufactured by Horiba, Ltd. or "Multisizer III" manufactured by Beckman Coulter), "ELS-800" (manufactured by Otsuka Electronics Co., Ltd.) using a laser Doppler method as an optical system, a flow particle image analyzer (such as "FPIA-3000S" manufactured by Sysmex Corporation), or the like.

A mass ratio between the shell particles (A) and the core particles (B) [(A):(B)] is preferably from 1:99 to 70:30. From a point of view of uniformity in a particle size of toner particles (C), heat-resistant storage stability of the liquid developer (X), and the like, the ratio [(A):(B)] above is more preferably from 2:98 to 50:50 and further preferably from 3:97 to 35:65. When a content (a mass ratio) of the shell particles is too low, blocking resistance of the toner particles may lower. When a content (a mass ratio) of the shell particles is too high, uniformity in particle size of the toner particles may lower.

From a point of view of uniformity in particle size of the toner particles (C), fluidity of the liquid developer (X), and heat-resistant storage stability of the liquid developer (X), a ratio of surface coverage of the core particles (B) with the shell particles (A) in the toner particles (C) is preferably not lower than 50% and more preferably not lower than 80%. Surface coverage means that the shell particles (A) are attached to or cover the surfaces of the core particles (B). The ratio of surface coverage of the core particles (B) with the shell particles (A) can be found, for example, based on an Equation (6) below, from analysis of an image obtained by a scanning electron microscope (SEM). By changing a ratio of surface coverage found in Equation (6) below, a shape of the toner particles (C) can be controlled.

$$\text{Surface coverage ratio (\%)} = \text{Area of core particles } (B) \text{ covered with shell particles } (A) / [(\text{Area of core particles } (B) \text{ covered with shell particles } (A) + \text{Area of core particles } (B) \text{ exposed through shell particles } (A))] \times 100 \quad \text{Equation (6)}$$

From a point of view of fixability of the toner particles (C) and heat-resistant storage stability of the liquid developer (X), a content of the toner particles (C) in the liquid developer (X) is preferably from 10 to 50 mass %, more preferably from 15 to 45 mass %, and further preferably from 20 to 40 mass %.

[Insulating Liquid]

The insulating liquid (L) preferably has a resistance value (approximately from $10^{11}$ to $10^{16}$ Ω·cm) to such an extent as not distorting an electrostatic latent image, and it is preferably a solvent having less odor and being low in toxicity. The insulating liquid (L) is preferably composed, for example, of aliphatic hydrocarbon, alicyclic hydrocarbon, aromatic hydrocarbon, halogenated hydrocarbon, polysiloxane, or the like. In particular from a point of view of odor, harmlessness, and cost, the insulating liquid (L) is preferably a normal paraffin based solvent, an isoparaffin based solvent, or the like, and it is more preferably, for example, Moresco White (manufactured by Matsumura Oil Research Corp.), Isopar (manufactured by Exxon Chemicals), Shellsol (manufactured by Shell Sekiyu K.K.), IP Solvent 1620 (manufactured by Idemitsu Petrochemical Co., Ltd.), IP Solvent 2028 (manufactured by Idemitsu Petrochemical Co., Ltd.), or the like.

[Method for Manufacturing Liquid Developer]

Though a method for manufacturing the liquid developer (X) according to the present embodiment is not particularly limited, for example, it preferably includes the steps of preparing a dispersion liquid obtained by dispersing the shell particles (A) containing the shell resin (a) in the insulating liquid (L) (a dispersion liquid (W) of the shell particles (A)), preparing a solution obtained by dissolving the core resin (b) (a solution (Y) for forming the core resin (b)), preparing a dispersion liquid in which a coloring agent is dispersed (a dispersion liquid of a coloring agent), dispersing the dispersion liquid of the coloring agent in the solution (Y) for forming the core resin (b), and dispersing the solution (Y) for forming the core resin (b) in the dispersion liquid (W) of the shell resin (A). More preferably, the method for manufacturing the liquid developer (X) according to the present embodiment includes as necessary, the step of distilling out a first organic solvent (M) contained in the solution (Y) for forming the core resin (b) after the step of dispersing the solution (Y) for forming the core resin (b) in the dispersion liquid (W) of the shell particles (A).

In the step of preparing the dispersion liquid (W) of the shell particles (A), the shell particles (A) may be manufactured and then the shell particles (A) may be dispersed in the insulating liquid (L), or the shell particles (A) may be manufactured through polymerization reaction or the like in the insulating liquid (L). The shell resin (a) contained in the shell particles (A) is preferably the resin exemplified in <Shell Resin (a)> above.

In a case where the shell particles (A) are manufactured and then the shell particles (A) are dispersed in the insulating liquid (L), a method of manufacturing the shell particles (A) is not particularly limited. A method of manufacturing the shell particles (A) in a dry method shown in [1] below may be employed, or a method of manufacturing the shell particles (A) in a wet method shown in [2] to [7] below may be employed. From a point of view of ease in manufacturing of the shell particles (A), a method of manufacturing the shell particles (A) is preferably a wet method, more preferably [4] below, [6] below, or [7] below, and further preferably [6] or [7] below.

[1]: The shell resin (a) is crushed with a dry method with the use of a known dry type crusher such as a jet mill.

[2]: Powders of the shell resin (a) are dispersed in an organic solvent, and the resultant product is crushed with a wet method with the use of a known wet type disperser such as a bead mill or a roll mill.

[3]: A solution of the shell resin (a) is sprayed and dried with the use of a spray dryer or the like.

[4]: A poor solvent is added to a solution of the shell resin (a) or the solution is cooled, to thereby supersaturate and precipitate the shell resin (a).

[5]: A solution of the shell resin (a) is dispersed in water or an organic solvent.

[6]: A precursor of the shell resin (a) is polymerized in water with an emulsion polymerization method, a soap-free emulsion polymerization method, a seed polymerization method, a suspension polymerization method, or the like.

[7]: A precursor of the shell resin (a) is polymerized in an organic solvent through dispersion polymerization or the like.

In the step of preparing the solution (Y) for forming the core resin (b), the core resin (b) or a precursor (b0) of the core resin (b) is preferably dissolved in the first organic solvent (M). A method of dissolving the core resin (b) or the precursor (b0) of the core resin (b) in the first organic solvent (M) may be any method and a known method can be employed. For example, a method of introducing the core resin (b) or the precursor (b0) of the core resin (b) in the first organic solvent (M) and then stirring the resultant product may be employed, or a method of introducing the core resin (b) or the precursor (b0) of the core resin (b) in the first organic solvent (M) and then heating the resultant product may be employed.

The organic solvent (M) dissolving the core resin (b) or the precursor (b0) of the core resin (b) is preferably selected as appropriate in accordance with a material for the core resin (b) or a material for the precursor (b0) of the core resin (b), and for example, it more preferably contains at least two of acetone, dimethylformamide, dimethyl sulfoxide, and N-methyl pyrrolidone.

The precursor (b0) of the core resin (b) is not particularly limited so long as it can become the core resin (b) through chemical reaction. The core resin (b) is preferably the resin exemplified in <Core Resin (b)> above.

In the step of preparing a dispersion liquid of a coloring agent, a coloring agent may be dispersed in at least one of the dispersion liquid (W) of the shell particles (A) and the solution (Y) for forming the core resin (b), or a coloring agent may be dispersed in a prescribed organic solvent and then the dispersion liquid may be dispersed in at least one of the dispersion liquid (W) of the shell particles (A) and the solution (Y) for forming the core resin (b).

In the step of dispersing the solution (Y) for forming the core resin (b) in the dispersion liquid (W) of the shell particles (A), the dispersion liquid (W) of the shell particles (A) and the solution (Y) for forming the core resin (b) are mixed. Thus, the solution (Y) for forming the core resin (b) is dispersed in the dispersion liquid (W) of the shell particles (A), and the toner particles (C) having the core-shell structure [that is, the toner particles (C) that the shell particles (A) are attached to or cover the surfaces of the core particles (B) containing the core resin (b)] are obtained. In a case where the solution (Y) for forming the core resin (b) contains the precursor (b0) of the core resin (b), the precursor (b0) of the core resin (b) reacts to become the core resin (b), and the core particles (B) containing the core resin (b) are formed.

Though a method of dispersing the solution (Y) for forming the core resin (b) in the dispersion liquid (W) of the shell particles (A) is not particularly limited, the solution (Y) for forming the core resin (b) is preferably dispersed in the dispersion liquid (W) of the shell particles (A) with the use of a dispersion apparatus. A dispersion apparatus is not particularly limited so long as it is generally commercially available as an emulsifier, a disperser, or the like.

Whether the core-shell structure that the shell particles (A) are attached to the surfaces of the core particles (B) or the core-shell structure that the shell particles (A) cover the surfaces of the core particles (B) is formed is dependent on physical properties of the first organic solvent (M) contained in the solution (Y) for forming the core resin (b), specifically, solubility of the shell particles (A) and/or the core resin (b) in the first organic solvent (M).

Specifically, when a solvent which dissolves the core resin (b) but does not dissolve the shell resin (a) is selected as the first organic solvent (M), the shell particles (A) are attached to the surfaces of the core particles (B).

On the other hand, when a solvent dissolving both of the shell resin (a) and the core resin (b) is selected as the first organic solvent (M), the shell particles (A) are attached to the surfaces of the core particles (B) while they are molten in the first organic solvent (M). Therefore, as the first organic solvent (M) is distilled out in a subsequent step, the first organic solvent (M) attached to the surfaces of the core particles (B) is also distilled out. Therefore, the surfaces of the core particles (B) are covered with the shell particles (A) and a film is formed. In order to obtain such a core-shell structure, the first organic solvent (M) is preferably acetone.

A content of the first organic solvent (M) in a dispersion liquid in which the solution for forming the core resin (b) is dispersed in the dispersion liquid of the shell particles (A) (the dispersion liquid (X') of the resin particles) is preferably from 10 to 50 mass % and more preferably from 20 to 40 mass %. In distilling out the first organic solvent (M) after the surfaces of the core particles (B) are covered with the shell particles (A), the first organic solvent (M) should only be removed until a content of the first organic solvent (M) in the dispersion liquid (X') of the resin particles at a temperature not higher than 40° C. is preferably not higher than 1 mass % and more preferably not higher than 0.5 mass %. Thus, a shell layer formed of the shell resin (a) which has been dissolved in the first organic solvent (M) is formed on the surface of the core layer formed of the core particles (B).

In manufacturing the core-shell structure in the present embodiment, the shell particles (A) manufactured in accordance with the manufacturing method in any of [1] to [7] above may be attached to or cover the surfaces of the core particles (B).

In the method for manufacturing the liquid developer (X) according to the present embodiment, an additive other than a coloring agent (such as a filler, an antistatic agent, a release agent, a charge control agent, a UV absorber, an antioxidant, an antiblocking agent, a heat-resistant stabilization agent, or a fire retardant) may be added to prepare at least one of the dispersion liquid (W) of the shell particles (A), the solution (Y) for forming the core resin (b), and the dispersion liquid of the coloring agent. In this case as well, by adding a solution in which an additive other than a coloring agent has been dissolved or dispersed to the dispersion liquid (W) of the shell particles (A) or the like, the additive can be added to the dispersion liquid (W) of the shell particles (A) or the like. Thus, the toner particles (C) in which an additive other than a coloring agent is contained in at least one layer of the core layer and the shell layer can be obtained.

[Image Formation Apparatus]

A liquid developer (X) according to the present embodiment is used in an image formation apparatus of an electrophotography type such as a copying machine, a printer, a digital printer, or a simple printer. In general, an image formation process of an electrophotography type is commonly used for these image formation apparatuses. An image formation apparatus in which the liquid developer (X) in the present embodiment is employed will be described hereinafter with reference to FIG. 1.

FIG. 1 shows an overall construction example of the image formation apparatus. It is noted that FIG. 1 mainly shows only constituent elements relating to the image formation process and shows constituent elements relating to paper feed, transportation, and paper ejection of a recording material in a simplified manner.

An image formation apparatus 10 shown in FIG. 1 includes a photoconductor drum 1 serving as an image carrier, a charging apparatus 2, an exposure apparatus 3, a wet type development apparatus 4, and a cleaning apparatus 6. In addition, image formation apparatus 10 also includes an intermediate transfer roller 5 serving as an intermediate transfer element and a secondary transfer roller 7.

Though only a single wet type development apparatus 4 is arranged in FIG. 1, a plurality of wet type development apparatuses may be arranged for forming a color image. A method of color development, whether or not to perform intermediate transfer, and the like may arbitrarily be set accordingly, and a construction of an image formation apparatus may arbitrarily be set. Though intermediate transfer roller 5 is employed in FIG. 1, a form of an intermediate transfer belt may be adopted.

Photoconductor drum 1 has a cylindrical shape having a photoconductor layer (not shown) formed on its surface and rotates in a direction shown with an arrow A in FIG. 1. Around photoconductor drum 1, cleaning apparatus 6, charging apparatus 2, exposure apparatus 3, wet type development apparatus 4, and intermediate transfer roller 5 are sequentially arranged along a direction of rotation of photoconductor drum 1. It is noted that such a system can operate normally at 100 to 1000 mm/sec.

Charging apparatus 2 charges a surface of photoconductor drum 1 to a prescribed potential. Exposure apparatus 3 forms an electrostatic latent image by irradiating the surface of photoconductor drum 1 with light and lowering a charged level within an irradiated region.

Wet type development apparatus 4 develops a latent image formed on photoconductor drum 1. Namely, a liquid developer 8 is transported to a development region of photoconductor drum 1 and toner particles contained in liquid developer 8 are supplied to the electrostatic latent image on the surface of photoconductor drum 1, so that a toner image is formed.

Wet type development apparatus 4 generally includes a development roller 41 carrying a thin layer of liquid developer 8 on its surface and developing a latent image on photoconductor drum 1 serving as an image carrier, a transportation roller 42 abutting to development roller 41 and moving liquid developer 8 of which liquid amount has been adjusted to a surface thereof, a supply roller 43 abutting to that transportation roller 42 and supplying liquid developer 8 within a developer tank 44 to a surface thereof, and restriction blades 45, 46 adjusting an amount of supply of liquid developer 8.

In a process for development, a development bias voltage the same in polarity as the toner particles is applied from a power supply (not shown) to development roller 41 of wet type development apparatus 4. Depending on balance with a potential of a latent image on photoconductor drum 1 similarly the same in polarity as the toner particles, difference in magnitude of electric field is formed, the toner particles in the developer are electrostatically adsorbed to photoconductor drum 1 in accordance with the latent image, and the latent image on photoconductor drum 1 is developed.

Intermediate transfer roller 5 is arranged to be opposed to photoconductor drum 1 and it rotates in a direction shown with an arrow B while it is in contact with photoconductor drum 1. At a nip portion between these intermediate transfer roller 5 and photoconductor drum 1, primary transfer from photoconductor drum 1 to intermediate transfer roller 5 is carried out.

In a primary transfer process, a transfer bias voltage reverse in polarity to the toner particles is applied from the power supply (not shown) to intermediate transfer roller 5. Thus, electric field is formed between intermediate transfer roller 5 and photoconductor drum 1 at a primary transfer position, and the toner image on photoconductor drum 1 is electrostatically adsorbed to intermediate transfer roller 5 and transferred onto intermediate transfer roller 5.

As the toner image is transferred onto intermediate transfer roller 5, cleaning apparatus 6 removes remaining toner particles on photoconductor drum 1 and next image formation is carried out. Intermediate transfer roller 5 and secondary transfer roller 7 are arranged to be opposed to each other with a recording material 11 lying therebetween, and they rotate in contact with each other with recording material 11 lying therebetween. At a nip portion between these intermediate transfer roller 5 and secondary transfer roller 7, secondary transfer from intermediate transfer roller 5 to recording material 11 is carried out.

Recording material 11 is transported in a direction shown with an arrow C to a secondary transfer position at the timing of secondary transfer. In the secondary transfer process, a transfer bias voltage reverse in polarity to the toner particles is applied from the power supply (not shown) to secondary transfer roller 7. Thus, electric field is formed between intermediate transfer roller 5 and secondary transfer roller 7, and the toner image on intermediate transfer roller 5 is electrostatically adsorbed onto recording material 11 which has passed between intermediate transfer roller 5 and secondary transfer roller 7 and transferred onto recording material 11. When the toner image is transferred onto recording material 11, cleaning apparatus 6 removes remaining toner particles on intermediate transfer roller 5 and next image formation is carried out.

A fixation portion 9 includes at least one pair of rollers arranged to be opposed to each other and rotating in contact with each other and recording material 11 is pressurized at a high temperature. Thus, toner particles forming a toner image on recording material 11 are fused and fixed to recording material 11.

EXAMPLES

Though the present invention will be described in further detail with reference to Examples, the present invention is not limited thereto.

Manufacturing Example 1

Manufacturing of Dispersion Liquid (W1) of Shell Particles (A1)

In a beaker made of glass, 100 parts by mass of 2-decyltetradecyl (meth)acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained.

Four hundred parts by mass of the obtained copolymer solution were dropped in 600 parts by mass of liquid petrolatum [relative dielectric constant: 2.0, SP value: 8.6 $(cal/cm^3)^{1/2}$] which was being stirred, and THF was distilled out at 40° C. at a reduced pressure of 0.039 MPa. Thus, a dispersion liquid (W1) of the shell particles (A1) was obtained.

A laser particle size distribution analyzer ("LA-920" manufactured by Horiba, Ltd.) was used to measure a volume average particle size of the shell particles (A1) in the dispersion liquid (W1), which was 0.12 μm.

Manufacturing Example 2

Manufacturing of Dispersion Liquid (W2) of Shell Particles (A2)

In a beaker made of glass, 80 parts by mass of 2-decyltetradecyl (meth)acrylate, 10 parts by mass of methyl methacrylate, 10 parts by mass of methacrylic acid, 0.2 part by mass of an isocyanate group containing monomer "Karenz MOI" [manufactured by Showa Denko K.K.], 10 parts by mass of a polyester resin, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained.

Four hundred parts by mass of the obtained copolymer solution were dropped in 600 parts by mass of liquid petrolatum [relative dielectric constant: 2.0, SP value: 8.6 $(cal/cm^3)^{1/2}$] which was being stirred, and THF was distilled out at 40° C. at a reduced pressure of 0.039 MPa. Thus, a dispersion liquid (W2) of shell particles (A2) was obtained.

A volume average particle size of the shell particles (A2) in the dispersion liquid (W2) was measured in accordance with the method described in Manufacturing Example 1 above, which was 0.13 μm.

Manufacturing Example 3

Manufacturing of Solution (Y1) for Forming Core Resin (b1)

In a reaction vessel provided with a stirrer, a heating and cooling apparatus, and a thermometer, 966 parts by mass of polyester (Mn: 5000) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 34 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b1) was obtained. One thousand parts by mass of the obtained core resin (b1) and 1000 parts by mass of acetone were introduced and stirred in a beaker, to thereby uniformly dissolve the core resin (b1) in acetone. Thus, a solution (Y1) for forming the core resin (b1) was obtained.

Manufacturing Example 4

Manufacturing of Solution (Y2) for Forming Core Resin (b2)

In a reaction vessel provided with a stirrer, a heating and cooling apparatus, and a thermometer, 965 parts by mass of polyester (Mn: 4000) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 35 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b2) was obtained. One thousand parts by mass of the obtained core resin (b2) and 1000 parts by mass of acetone were introduced and stirred in a beaker, to thereby uniformly dissolve the core resin (b2) in acetone. Thus, a solution (Y2) for forming the core resin (b2) was obtained.

Manufacturing Example 5

Manufacturing of Solution (Y3) for Forming Core Resin (b3)

In a reaction vessel provided with a stirrer, a heating and cooling apparatus, and a thermometer, 894 parts by mass of polyester (Mn: 1600) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 106 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b3) was obtained. One thousand parts by mass of the obtained core resin (b3) and 1000 parts by mass of acetone were introduced and stirred in a beaker, to thereby uniformly dissolve the core resin (b3) in acetone. Thus, a solution (Y3) for forming the core resin (b3) was obtained.

Manufacturing Example 6

[Manufacturing of Solution (Y4) for Forming Core Resin (b4)]

In a reaction vessel provided with a stirrer, a heating and cooling apparatus, and a thermometer, 980 parts by mass of polyester (Mn: 9100) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 20 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b4) was obtained. One thousand parts by mass of the obtained core resin (b4) and 1000 parts by mass of acetone were introduced and stirred in a beaker, to thereby uniformly dissolve the core resin (b4) in acetone. Thus, a solution (Y4) for forming the core resin (b4) was obtained.

Manufacturing Example 7

Manufacturing of Solution (Y5) for Forming Core Resin (b5)

In a reaction vessel provided with a stirrer, a heating and cooling apparatus, and a thermometer, 925 parts by mass of polyester (Mn: 2600) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 75 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b5) was obtained. One thousand parts by mass of the obtained core resin (b5) and 1000 parts by mass of acetone were introduced and stirred in a beaker, to thereby uniformly dissolve the core resin (b5) in acetone. Thus, a solution (Y5) for forming the core resin (b5) was obtained.

Manufacturing Example 8

Manufacturing of Solution (Y6) for Forming Core Resin (b6)

In a reaction vessel provided with a stirrer, a heating and cooling apparatus, and a thermometer, 920 parts by mass of polyester (Mn: 1900) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 80 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b6) was obtained. One thousand parts by mass of the obtained core resin (b6) and 1000 parts by mass of acetone were introduced and stirred in a beaker, to thereby uniformly dissolve the core resin (b6) in acetone. Thus, a solution (Y6) for forming the core resin (b6) was obtained.

Manufacturing Example 9

Manufacturing of Solution (Y7) for Forming Core Resin (b7)

In a reaction vessel provided with a stirrer, a heating and cooling apparatus, and a thermometer, 867 parts by mass of polyester (Mn: 1200) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 133 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b7) was obtained. One thousand parts by mass of the obtained core resin (b7) and 1000 parts by mass of acetone were introduced and stirred in a beaker, to thereby uniformly dissolve the core resin (b7) in acetone. Thus, a solution (Y7) for forming the core resin (b7) was obtained.

Manufacturing Example 10

Manufacturing of Solution (Y8) for Forming Core Resin (b8)

In a reaction vessel provided with a stirrer, a heating and cooling apparatus, and a thermometer, 987 parts by mass of polyester (Mn: 13000) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 13 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b8) was obtained. One thousand parts by mass of the obtained core resin (b8) and 1000 parts by mass of acetone were introduced and stirred in a beaker, to thereby uniformly dissolve the core resin (b8) in acetone. Thus, a solution (Y8) for forming the core resin (b8) was obtained.

Manufacturing Example 11

Manufacturing of Solution (Y9) for Forming Core Resin (b9)

In a reaction vessel provided with a stirrer, a heating and cooling apparatus, and a thermometer, 927 parts by mass of polyester (Mn: 2700) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 73 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b9) was obtained. One thousand parts by mass of the obtained core resin (b9) and 1000 parts by mass of acetone were introduced and stirred in a beaker, to thereby uniformly dissolve the core resin (b9) in acetone. Thus, a solution (Y9) for forming the core resin (b9) was obtained.

Manufacturing Example 12

Manufacturing of Solution (Y10) for Forming Core Resin (b10)

In a reaction vessel provided with a stirrer, a heating and cooling apparatus, and a thermometer, 971 parts by mass of polyester (Mn: 4500) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 29 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b10) was obtained. One thousand parts by mass of the obtained core resin (b10) and 1000 parts by mass of acetone were introduced and stirred in a beaker, to thereby uniformly dissolve the core resin (b10) in acetone. Thus, a solution (Y10) for forming the core resin (b10) was obtained.

Manufacturing Example 13

Manufacturing of Solution (Y11) for Forming Core Resin (b11)

In a reaction vessel provided with a stirrer, a heating and cooling apparatus, and a thermometer, 894 parts by mass of polyester (Mn: 1800) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 106 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b11) was obtained. One thousand parts by mass of the obtained core resin (b11) and 1000 parts by mass of acetone were introduced and stirred in a beaker, to thereby uniformly dissolve the core resin (b11) in acetone. Thus, a solution (Y11) for forming the core resin (b11) was obtained.

Manufacturing Example 14

Manufacturing of Solution (Y12) for Forming Core Resin (b12)

In a reaction vessel provided with a stirrer, a heating and cooling apparatus, and a thermometer, 990 parts by mass of polyester (Mn: 14500) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 10 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b12) was obtained. One thousand parts by mass of the obtained core resin (b12) and 1000 parts by mass of acetone were introduced and stirred in a beaker, to thereby uniformly dissolve the core resin (b12) in acetone. Thus, a solution (Y12) for forming the core resin (b12) was obtained.

Manufacturing Example 15

Manufacturing of Solution (Y13) for Forming Core Resin (b13)

In a reaction vessel provided with a stirrer, a heating and cooling apparatus, and a thermometer, 870 parts by mass of polyester (Mn: 1300) obtained from sebacic acid, adipic acid, and ethylene glycol (a molar ratio of 0.8:0.2:1) and 300 parts by mass of acetone were introduced and stirred, to thereby uniformly dissolve polyester in acetone. In this solution, 130 parts by mass of isophoron diisocyanate (IPDI) were introduced and caused to react for 6 hours at 80° C. When an NCO value of a product obtained through reaction attained to 0, 28 parts by mass of trimellitic anhydride were introduced and caused to react for 1 hour at 180° C. Thus, a core resin (b13) was obtained. One thousand parts by mass of the obtained core resin (b13) and 1000 parts by mass of acetone were introduced and stirred in a beaker, to thereby uniformly dissolve the core resin (b13) in acetone. Thus, a solution (Y13) for forming the core resin (b13) was obtained.

Manufacturing Example 16

Manufacturing of Solution (Y14) for Forming Core Resin (b14)

In an autoclave reaction chamber provided with a thermometer, a stirrer, and a nitrogen introduction pipe, 452 parts by mass of xylene were introduced. After replacement with nitrogen, at 170° C., a mixture of a mixed monomer of 845 parts by mass of styrene and 155 parts by mass of n-butyl acrylate, 6.4 parts by mass of di-t-butyl peroxide serving as an initiator, and 125 parts by mass of xylene was dropped into xylene in the autoclave reaction chamber for 3 hours. After maturation for 1 hour at 170° C. after dropping, polymerization reaction was completed. Thereafter, by desolventization at a reduced pressure, a core resin (b14) was obtained. One thousand parts by mass of the obtained core resin (b14) and 1000 parts by mass of acetone were introduced and stirred in a beaker, to thereby uniformly dissolve the core resin (b14) in acetone. Thus, a solution (Y14) for forming the core resin (b14) was obtained.

Mn of the core resin (b14) was measured in accordance with <Method of Measuring Mn> below, and Mn of the core resin (b14) was 28000. A differential scanning calorimetry apparatus ("DSC6200" manufactured by Seiko Instruments, Inc.) was used to measure Tg of the core resin (b14), with a mass of a sample being set to 20 mg and a temperature increase rate being set to 10° C./min., and Tg of the core resin (b14) was 60° C.

Manufacturing Example 17

Manufacturing of Solution (Y15) for Forming Core Resin (b15)

In a reaction vessel provided with a cooling pipe, a stirrer, and a nitrogen introduction pipe, 343 parts by mass of a 2-mole adduct of EO to bisphenol A, 166 parts by mass of isophthalic acid, and 2 parts by mass of dibutyl tin oxide were introduced and caused to react for 8 hours at 230° C. at atmospheric pressure. In addition, after reaction for 5 hours at a reduced pressure from 10 to 15 mmHg, cooling to 110° C. was carried out. In toluene, 17 parts by mass of isophoron diisocyanate were introduced and caused to react for 5 hours at 110° C., followed by desolventization, to thereby obtain a core resin (b15). One thousand parts by mass of the obtained core resin (b15) and 1000 parts by mass of acetone were introduced and stirred in a beaker, to thereby uniformly dissolve the core resin (b15) in acetone. Thus, a solution (Y15) for forming the core resin (b15) was obtained.

Mn of the core resin (b15) was measured in accordance with <Method of Measuring Mn> below, and Mn of the core resin (b15) was 36000. In addition, Tg of the core resin (b15) was measured in accordance with the method described in Manufacturing Example 16 above, and Tg of the core resin (b15) was 62° C.

Manufacturing Example 18

Manufacturing of Dispersion Liquid 1 of Coloring Agent

In a beaker, 10 parts by mass of nigrosine (manufactured by Orient Chemical Industries Co., Ltd., TH-827), 25 parts by mass of carbon black (manufactured by Cabot Corporation, MOGUL-L), 7 parts by mass of a dispersant for coloring agent (manufactured by Ajinomoto Fine-Techno Co., Inc., Ajisper PB-821), and 140 parts by mass of acetone were introduced and stirred, to thereby uniformly disperse the coloring agents (nigrosine and carbon black). Thereafter, the coloring agents were finely dispersed with the use of a bead mill, to thereby obtain a dispersion liquid 1 of coloring agent. A volume average particle size of the coloring agents in the dispersion liquid 1 of coloring agent was measured in accordance with the method described in Manufacturing Example 1 above, which was 0.18 μ*m*.

Manufacturing Example 19

Manufacturing of Dispersion Liquid 2 of Coloring Agent

In a beaker, 2 parts by mass of nigrosine (manufactured by Orient Chemical Industries Co., Ltd., TH-827), 46 parts by mass of carbon black (manufactured by Cabot Corporation, MOGUL-L), 9.6 parts by mass of a dispersant for coloring agent (manufactured by Ajinomoto Fine-Techno Co., Inc., Ajisper PB-821), and 192 parts by mass of acetone were introduced and stirred, to thereby uniformly disperse the coloring agents. Thereafter, the coloring agents were finely dispersed with the use of a bead mill, to thereby obtain a dispersion liquid 2 of coloring agent. A volume average particle size of the coloring agents in the dispersion liquid 2 of coloring agent was measured in accordance with the method described in Manufacturing Example 1 above, which was 0.17 μm.

Manufacturing Example 20

Manufacturing of Dispersion Liquid 3 of Coloring Agent

In a beaker, 15 parts by mass of nigrosine (manufactured by Orient Chemical Industries Co., Ltd., TH-827), 7 parts by mass of carbon black (manufactured by Cabot Corporation, MOGUL-L), 4.4 parts by mass of a dispersant for coloring agent (manufactured by Ajinomoto Fine-Techno Co., Inc., Ajisper PB-821), and 88 parts by mass of acetone were introduced and stirred, to thereby uniformly disperse the coloring agents. Thereafter, the coloring agents were finely dispersed with the use of a bead mill, to thereby obtain a dispersion liquid 3 of coloring agent. A volume average particle size of the coloring agents in the dispersion liquid 3 of coloring agent was measured in accordance with the method described in Manufacturing Example 1 above, which was 0.21 μm.

Manufacturing Example 21

Manufacturing of Dispersion Liquid 4 of Coloring Agent

In a beaker, 15 parts by mass of nigrosine (manufactured by Orient Chemical Industries Co., Ltd., TH-827), 33 parts by mass of carbon black (manufactured by Cabot Corporation, MOGUL-L), 9.6 parts by mass of a dispersant for coloring agent (manufactured by Ajinomoto Fine-Techno Co., Inc., Ajisper PB-821), and 192 parts by mass of acetone were introduced and stirred, to thereby uniformly disperse the coloring agents. Thereafter, the coloring agents were finely dispersed with the use of a bead mill, to thereby obtain a dispersion liquid 4 of coloring agent. A volume average particle size of the coloring agents in the dispersion liquid 4 of coloring agent was measured in accordance with the method described in Manufacturing Example 1 above, which was 0.19 μm.

Manufacturing Example 22

Manufacturing of Dispersion Liquid 5 of Coloring Agent

In a beaker, 20 parts by mass of nigrosine (manufactured by Orient Chemical Industries Co., Ltd., TH-827), 4 parts by mass of a dispersant for coloring agent (manufactured by Ajinomoto Fine-Techno Co., Inc., Ajisper PB-821), and 80 parts by mass of acetone were introduced and stirred, to thereby uniformly disperse the coloring agent (nigrosine). Thereafter, the coloring agent was finely dispersed with the use of a bead mill, to thereby obtain a dispersion liquid 5 of coloring agent. A volume average particle size of the coloring agent in the dispersion liquid 5 of coloring agent was measured in accordance with the method described in Manufacturing Example 1 above, which was 0.22 μm.

Manufacturing Example 23

Manufacturing of Dispersion Liquid 6 of Coloring Agent

In a beaker, 35 parts by mass of carbon black (manufactured by Cabot Corporation, MOGUL-L), 7 parts by mass of a dispersant for coloring agent (manufactured by Ajinomoto Fine-Techno Co., Inc., Ajisper PB-821), and 140 parts by mass of acetone were introduced and stirred, to thereby uniformly disperse the coloring agent (carbon black). Thereafter, the coloring agent was finely dispersed with the use of a bead mill, to thereby obtain a dispersion liquid 6 of coloring agent. A volume average particle size of the coloring agent in the dispersion liquid 6 of coloring agent was measured in accordance with the method described in Manufacturing Example 1 above, which was 0.17 μm.

Manufacturing Example 24

Manufacturing of Dispersion Liquid 7 of Coloring Agent

In a beaker, 12.5 parts by mass of carbon black (manufactured by Cabot Corporation, MOGUL-L), 2.5 parts by mass of a dispersant for coloring agent (manufactured by Ajinomoto Fine-Techno Co., Inc., Ajisper PB-821), and 50 parts by mass of acetone were introduced and stirred, to thereby uniformly disperse the coloring agent (carbon black). Thereafter, the coloring agent was finely dispersed with the use of a bead mill, to thereby obtain a dispersion liquid 7 of coloring agent. A volume average particle size of the coloring agent in the dispersion liquid 7 of coloring agent was measured in accordance with the method described in Manufacturing Example 1 above, which was 0.19 μm.

Manufacturing Example 25

Manufacturing of Dispersion Liquid 8 of Coloring Agent

In a beaker, 22 parts by mass of nigrosine (manufactured by Orient Chemical Industries Co., Ltd., TH-827), 25 parts by mass of carbon black (manufactured by Cabot Corporation, MOGUL-L), 9.4 parts by mass of a dispersant for coloring agent (manufactured by Ajinomoto Fine-Techno Co., Inc., Ajisper PB-821), and 188 parts by mass of acetone were introduced and stirred, to thereby uniformly disperse the coloring agents. Thereafter, the coloring agents were finely dispersed with the use of a bead mill, to thereby obtain a dispersion liquid 8 of coloring agent. A volume average particle size of the coloring agents in the dispersion liquid 8 of coloring agent was measured in accordance with the method described in Manufacturing Example 1 above, which was 0.21 μm.

Example 1

Forty five parts by mass of the solution (Y1) for forming the core resin (b1) obtained in Manufacturing Example 3 above and 39.4 parts by mass of the dispersion liquid of the coloring agent obtained in Manufacturing Example 18 above were introduced in a beaker and stirred at 8000 rpm with the use of T.K. Auto Homo Mixer (manufactured by Tokushu Kika Kogyo Co., Ltd.) at 25° C. Thus, a resin solution (1A) in which the coloring agents (nigrosine and carbon black) were uniformly dispersed was obtained.

In another beaker, 67 parts by mass of liquid petrolatum and 6 parts by mass of the dispersion liquid (W1) of the shell particles (A) were introduced to uniformly disperse the shell particles (A). Then, while T.K. Auto *Homo* Mixer was used at 25° C. to perform stirring at 10000 rpm, 60 parts by mass of the resin solution (Y11) were introduced and stirred for 2 minutes.

A liquid mixture thus obtained was introduced in a reaction vessel provided with a stirrer, a heating and cooling apparatus, a thermometer, and a desolventizer, and a temperature was raised to 35° C. Thereafter, at a reduced pressure of 0.039 MPa at 35° C., acetone was distilled out until a concentration of acetone in the liquid mixture above was not higher than 0.5 mass %. Thus, a liquid developer was obtained.

A concentration of acetone in the liquid developer was quantified with the use of gas chromatography "GC2010" [FID type, manufactured by Shimadzu Corporation]. Solubility (25° C.) of the shell resin (a) in the insulating liquid (L) in the liquid developer was measured in accordance with a method shown below, which was 3 mass %. A volume average particle size of the toner particles (C) was measured in accordance with the method described in Manufacturing Example 1 above, which was 2.0 μm.

<Method of Measuring Solubility>

Ten grams of the liquid developer were centrifuged for 30 minutes at 10000 rpm at 25° C. and a whole amount of a supernatant was collected. Ten milliliters of the insulating liquid (L) were added to a solid content which remained without being collected, and the solid content was dispersed again. This solution was centrifuged for 30 minutes at 10000 rpm at 25° C. and a whole amount of a supernatant was collected. This operation was further repeated and the supernatant was collected three times in total. A reduced-pressure dryer was used to dry the whole collected supernatant for 1 hour at a reduced pressure of 20 mmHg at a temperature as high as a boiling point of the insulating liquid. Thereafter, a mass of the residue was weighed. A mass Y (g) of the residue at this time and a mass y (g) of the shell resin (a) in 10 g of the liquid developer are substituted in an Equation (7) below, so that solubility of the shell resin (a) in the insulating liquid at 25° C. can be found. Here, mass y (g) of the shell resin (a) in 10 g of the liquid developer is a value found from the mass of the shell resin (a) added during manufacturing of the liquid developer (X).

$$[\text{Solubility of shell resin (a) in insulating liquid at } 25^\circ \text{ C.}]=(Y/y)\times 100 \qquad \text{Equation (7)}$$

Examples 2 to 10, Comparative Examples 1 to 13

Liquid developers in Examples 2 to 10 and Comparative Examples 1 to 13 were obtained as in Example 1 above, except that a type and an amount of addition of a dispersion liquid of shell particles, a solution for forming a core resin, and a dispersion liquid of a coloring agent were changed as shown in Table 1.

TABLE 1

| | Dispersion Liquid of Shell Particles | | Solution for Forming Core Resin | | Dispersion Liquid of Coloring Agent | |
|---|---|---|---|---|---|---|
| | Type | Content (parts by mass) | Type | Content (parts by mass) | Type | Content (parts by mass) |
| Example 1 | W1 | 6 | Y1 | 45 | 1 | 39.4 |
| Example 2 | W1 | 6 | Y2 | 45 | 1 | 39.4 |
| Example 3 | W1 | 6 | Y3 | 45 | 1 | 39.4 |
| Example 4 | W1 | 6 | Y4 | 45 | 1 | 39.4 |
| Example 5 | W1 | 6 | Y5 | 45 | 1 | 39.4 |
| Example 6 | W2 | 6 | Y1 | 45 | 1 | 39.4 |
| Example 7 | W1 | 6 | Y1 | 45 | 2 | 54 |
| Example 8 | W1 | 6 | Y1 | 45 | 3 | 24.8 |
| Example 9 | W1 | 6 | Y1 | 45 | 4 | 54 |
| Example 10 | W1 | 6 | Y1 | 45 | 5 | 22.5 |
| Comparative Example 1 | W1 | 6 | Y14 | 45 | 1 | 39.4 |
| Comparative Example 2 | W1 | 6 | Y15 | 45 | 1 | 39.4 |
| Comparative Example 3 | W1 | 6 | Y1 | 45 | 6 | 39.4 |
| Comparative Example 4 | W1 | 6 | Y6 | 45 | 1 | 39.4 |
| Comparative Example 5 | W1 | 6 | Y7 | 45 | 1 | 39.4 |
| Comparative Example 6 | W1 | 6 | Y8 | 45 | 1 | 39.4 |
| Comparative Example 7 | W1 | 6 | Y9 | 45 | 1 | 39.4 |
| Comparative Example 8 | W1 | 6 | Y10 | 45 | 1 | 39.4 |
| Comparative Example 9 | W1 | 6 | Y11 | 45 | 1 | 39.4 |
| Comparative Example 10 | W1 | 6 | Y12 | 45 | 1 | 39.4 |
| Comparative Example 11 | W1 | 6 | Y13 | 45 | 1 | 39.4 |
| Comparative Example 12 | W1 | 6 | Y1 | 45 | 7 | 14.1 |
| Comparative Example 13 | W1 | 6 | Y1 | 45 | 8 | 52.9 |

[Relation Between Mn of Core Resin (b) and Urethane Group Concentration in Core Resin (b)]

With regard to the core resins (b) obtained in Manufacturing Examples 3 to 15 above, Mn of the core resin (b) was measured in accordance with the method shown in <Method of Measuring Mn> below, and a urethane group concentration in the core resin (b) was measured in accordance with the method shown in <Method of Measuring Urethane Group Concentration> below.

<Method of Measuring Mn>

Measurement was conducted with GPC under conditions below.

Measurement Apparatus: "HLC-8220GPC" manufactured by Tosoh Corporation

Column: Shodex KF-404HQ and Shodex KF-402HQ (each manufactured by Showa Denko K.K.)

Sample Solution: 0.25 mass % of THF solution

Amount of Injection of Sample Solution into Column: 100 μl

Flow Rate: 0.3 ml/min.

Detection Apparatus: RI (refraction index) detector

Calibration Curve: Standard polystyrene

<Method of Measuring Urethane Group Concentration>

Measurement was conducted with GCMS. Specifically, the core resin (b) was pyrolized, and then a urethane group concentration in the core resin (b) was measured with GCMS under conditions below. A urethane group concentration in the core resin (b) was calculated by using a ratio of ionic strength detected from the pyrolized core resin (b).

A urethane group concentration in the core resin (b) was measured under conditions shown below.

Apparatus: "QP2010" manufactured by Shimadzu Corporation

Column: "UltraALLOY-5" manufactured by Frontier Laboratories Ltd. (inner diameter: 0.25 mm, length: 30 m, thickness: 0.25 μm)

Temperature Increase Condition: Temperature Increase Range: 100° C. to 320° C. (held at 320° C.), Rate of Temperature Increase: 20° C./min.

Pyrolysis of the core resin (b) at the time of measurement of a urethane group concentration in the core resin (b) was carried out under conditions shown below.

Apparatus: "PY-2020iD" manufactured by Frontier Laboratories Ltd.

Mass of Sample: 0.1 mg

Heating Temperature: 550° C.

Heating Time Period: 0.5 minute.

Figure 2:
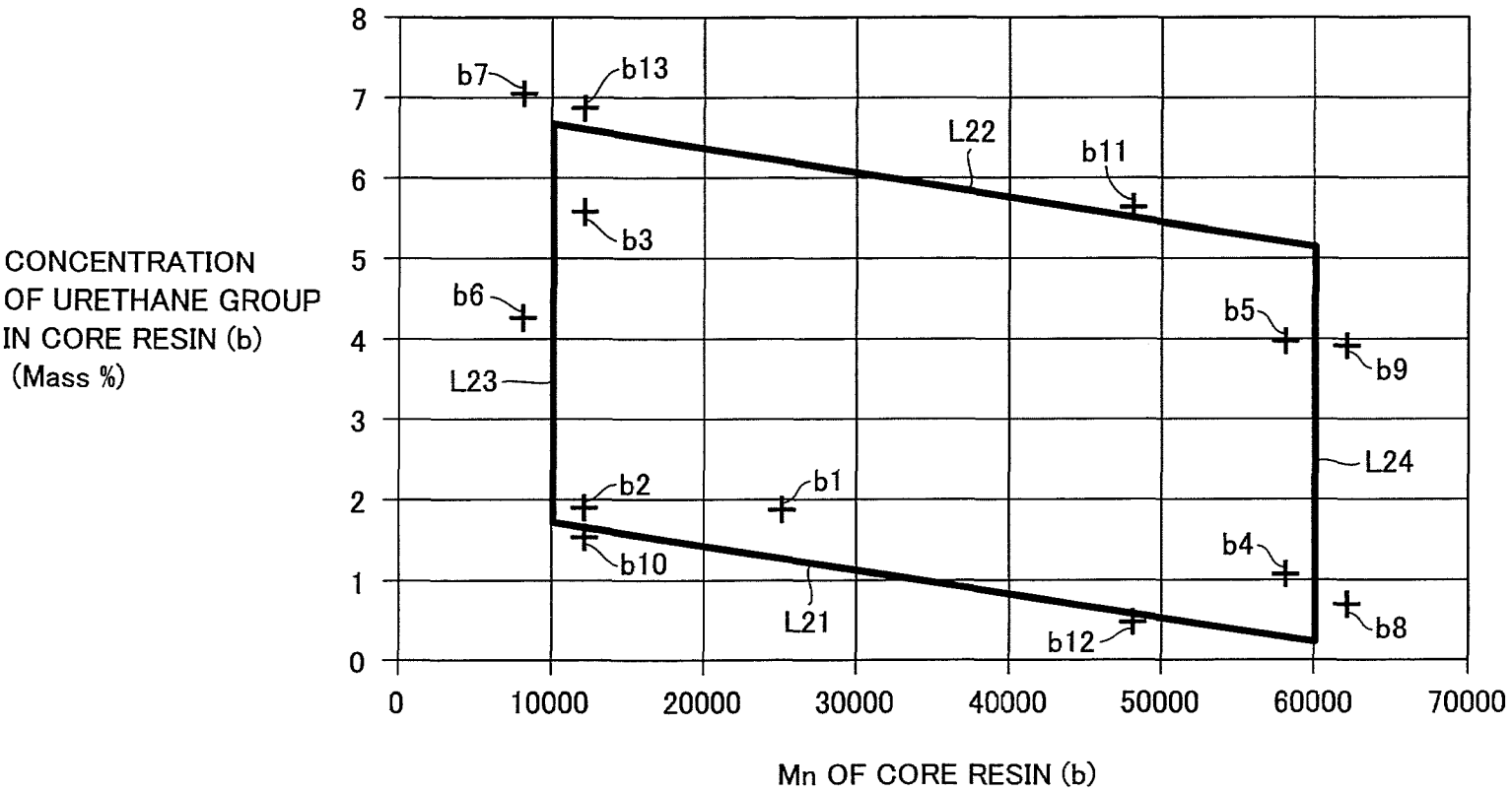
FIG. 2 is a graph showing results in Examples and Comparative Examples.

Table 2 and FIG. 2 show measured Mn of the core resin (b) and the urethane group concentration in the core resin (b). FIG. 2 is a graph showing relation between Mn of the core resin (b) and the urethane group concentration in the core resin (b). L21 to L24 in FIG. 2 will be described later.

TABLE 2

| | Mn | Urethane Group Concentration (Mass %) |
|---|---|---|
| Core Resin (b1) | 25000 | 1.81 |
| Core Resin (b2) | 12000 | 1.86 |
| Core Resin (b3) | 12000 | 5.61 |
| Core Resin (b4) | 58000 | 1.07 |
| Core Resin (b5) | 58000 | 3.99 |
| Core Resin (b6) | 8000 | 4.24 |
| Core Resin (b7) | 8000 | 7.05 |
| Core Resin (b8) | 62000 | 0.71 |
| Core Resin (b9) | 62000 | 3.86 |
| Core Resin (b10) | 12000 | 1.56 |
| Core Resin (b11) | 48000 | 5.62 |

TABLE 2-continued

| | Mn | Urethane Group Concentration (Mass %) |
|---|---|---|
| Core Resin (b12) | 48000 | 0.56 |
| Core Resin (b13) | 12000 | 6.91 |

<Method of Evaluation of Image Density>

An image formation apparatus shown in FIG. 1 was used to print the liquid developers in Examples 1 to 10 and Comparative Examples 1 to 13 on coated paper (trade name: "OK top coat+", weighing capacity: 128 g/cm$^2$, manufactured by Oji Paper Co., Ltd.). to thereby form a solid fill image of which toner attachment amount was 2 g/m$^2$. Thereafter, image density of a solid black portion in the formed solid fill image was measured with "X-Rite model 404" manufactured by X-Rite, Incorporated. Table 3 shows measurement results.

TABLE 3

| | Type of Core Resin | Content of Nigrosine (parts by mass) | Content of Carbon Black (parts by mass) | Volume Average Particle Size of Toner Particles (μm) | Image Density | Glossiness of Image |
|---|---|---|---|---|---|---|
| Example 1 | b1 | 10 | 25 | 2 | B1 | A2 |
| Example 2 | b2 | 10 | 25 | 1.7 | B1 | A2 |
| Example 3 | b3 | 10 | 25 | 1.6 | B1 | A2 |
| Example 4 | b4 | 10 | 25 | 2.8 | B1 | A2 |
| Example 5 | b5 | 10 | 25 | 2.7 | B1 | A2 |
| Example 6 | b1 | 10 | 25 | 2.2 | B1 | A2 |
| Example 7 | b1 | 2 | 46 | 2.3 | A1 | B2 |
| Example 8 | b1 | 15 | 7 | 1.8 | B1 | A2 |
| Example 9 | b1 | 15 | 33 | 2.4 | A1 | B2 |
| Example 10 | b1 | 20 | 0 | 1.9 | B1 | B2 |
| Comparative Example 1 | b14 | 10 | 25 | 2.5 | B1 | C2 |
| Comparative Example 2 | b15 | 10 | 25 | 2.8 | B1 | C2 |
| Comparative Example 3 | b1 | 0 | 35 | 2.1 | B1 | C2 |
| Comparative Example 4 | b6 | 10 | 25 | 1.5 | C1 | C2 |
| Comparative Example 5 | b7 | 10 | 25 | 1.4 | C1 | C2 |
| Comparative Example 6 | b8 | 10 | 25 | 3.2 | B1 | C2 |
| Comparative Example 7 | b9 | 10 | 25 | 3.5 | B1 | C2 |
| Comparative Example 8 | b10 | 10 | 25 | 1.2 | C1 | C2 |
| Comparative Example 9 | b11 | 10 | 25 | 2.2 | B1 | C2 |
| Comparative Example 10 | b12 | 10 | 25 | 2.4 | B1 | C2 |
| Comparative Example 11 | b13 | 10 | 25 | 2.7 | C1 | C2 |
| Comparative Example 12 | b1 | 0 | 12.5 | 1.9 | C1 | B2 |
| Comparative Example 13 | b1 | 22 | 25 | 2.3 | C1 | C2 |

Table 3 shows "A1" when image density was not lower than 1.8, shows "B1" when image density was not lower than 1.7 and lower than 1.8, and shows "C1" when image density was lower than 1.7.

<Method of Evaluating Glossiness of Image>

Coated paper obtained in <Method of Evaluation of Image Density> above and Gloss Meter VC2000 (manufactured by Nippon Denshoku Industries Co., Ltd.) were used to measure a degree of gloss of a coated paper surface in which a solid fill image had been formed. Table 3 shows measurement results.

Table 3 shows "A2" when a degree of gloss was not lower than 60, shows "B2" when a degree of gloss was not lower than 50 and lower than 60, and shows "C2" when a degree of gloss was lower than 50. A higher degree of gloss indicates an image excellent in glossiness.

<Discussion>

As shown in Table 3, in Examples 1 to 10, image density was high and an image had excellent glossiness. Since the image had excellent glossiness, it is considered that fixability of toner particles was also excellent. One of the reasons for this may be because a content of nigrosine in the toner particles in Examples 1 to 10 is not lower than 1 mass % and not higher than 20 mass %.

Specifically, since a content of nigrosine in the toner particles is not lower than 1 mass % and not higher than 20 mass %, a crystallization temperature of a crystalline resin (at least the core resins (b1) to (b5)) is lowered. Therefore, the crystalline resin molten at the time of fixation is crystallized at a lower temperature. Therefore, since a surface of an image is smoothened in Examples 1 to 10, glossiness of the image was improved.

When Example 2 is compared with Comparative Example 4 and Comparative Example 8, however, there was a difference in image density and glossiness of an image in spite of the same content of nigrosine in the toner particles. The reason for this may be because the core resin (b) in Example 2 (the core resin (b2)) has prescribed viscoelasticity.

Specifically, as can be seen in FIG. 2, Mn of the core resin (b) in Comparative Example 4 (the core resin (b6)) is smaller than Mn of the core resin (b) in Example 2 (the core resin (b2)). Therefore, it is considered that melt viscosity of the core resin (b) was too low in Comparative Example 4, and hence elasticity of the core resin could not be maintained in a high-temperature region and thus hot offset occurred. Consequently, image intensity lowered and glossiness of the image also lowered.

In addition, as can be seen in FIG. 2, the urethane group concentration of the core resin (b) in Comparative Example 8 (the core resin (b10)) is lower than the urethane group concentration of the core resin (b) in Example 2 (the core resin (b2)). Therefore, since melt viscosity of the core resin (b) is too low also in Comparative Example 8, image density was lowered and glossiness of the image was also lowered.

When Example 3 is compared with Comparative Example 5 and Comparative Example 11, there was a difference in image density and glossiness of an image in spite of the same content of nigrosine in the toner particles. The reason for this may also be because the core resin (b) in Example 3 (the core resin (b3)) has prescribed viscoelasticity.

Specifically, as can be seen in FIG. 2, Mn of the core resin (b) in Comparative Example 5 (the core resin (b7)) is smaller than Mn of the core resin (b) in Example 3 (the core resin (b3)). Therefore, in Comparative Example 5 as well, since melt viscosity of the core resin (b) is too low, it is considered that elasticity of the core resin in a high-temperature region could not be maintained and hence hot offset occurred. Consequently, image density was lowered and glossiness of the image was also lowered.

In addition, as can be seen in FIG. 2, the urethane group concentration of the core resin (b) in Comparative Example 11 (the core resin (b13)) is higher than the urethane group concentration of the core resin (b) in Example 3 (the core resin (b3)). Therefore, since melt viscosity of the core resin (b) is too high in Comparative Example 11, fixability of the toner particles was lowered and consequently glossiness of the image was lowered.

When Example 4 is compared with Comparative Example 6 and Comparative Example 10, there was a difference in image density and glossiness of an image in spite of the same content of nigrosine in the toner particles. The reason for this may also be because the core resin (b) in Example 4 (the core resin (b4)) has prescribed viscoelasticity.

Specifically, as can be seen in FIG. 2, Mn of the core resin (b) in Comparative Example 6 (the core resin (b8)) is greater than Mn of the core resin (b) in Example 4 (the core resin (b4)). Therefore, in Comparative Example 6, since melt viscosity of the core resin (b) is too high, it is considered that lowering in fixability of the toner particles was caused and glossiness of the image was consequently lowered.

Moreover, as can be seen in FIG. 2, the urethane group concentration in the core resin (b) in Comparative Example 10 (the core resin (b12)) is lower than the urethane group concentration in the core resin (b) in Example 4 (the core resin (b4)). Therefore, since melt viscosity of the core resin (b) was too low in Comparative Example 10, it is considered that elasticity of the core resin in a high-temperature region could not be maintained and thus hot offset occurred. Consequently, image density lowered and glossiness of the image also lowered.

When Example 5 and Comparative Example 7 and Comparative Example 9 are compared with each other, there was a difference in image density and glossiness of an image in spite of the same content of nigrosine in the toner particles. The reason for this may also be because the core resin (b) in Example 5 (the core resin (b5)) has prescribed viscoelasticity.

Specifically, as can be seen in FIG. 2, Mn of the core resin (b) in Comparative Example 7 (the core resin (b9)) is greater than Mn of the core resin (b) in Example 5 (the core resin (b5)). Therefore, in Comparative Example 7, since melt viscosity of the core resin (b) is too high, lowering in fixability of the toner particles was caused and glossiness of the image was consequently lowered.

Moreover, as can be seen in FIG. 2, the urethane group concentration in the core resin (b) in Comparative Example 9 (the core resin (b11)) is higher than the urethane group concentration in the core resin (b) in Example 5 (the core resin (b5)). Therefore, since melt viscosity of the core resin (b) was too high also in Comparative Example 9, lowering in fixability of the toner particles was caused and glossiness of the image was consequently lowered.

Furthermore, as can be seen in FIG. 2, in Example 1, Mn of the core resin (b) (the core resin (b1)) is greater than that in Comparative Examples 4 to 5 and smaller than that in Comparative Examples 6 to 7, and the urethane group concentration in the core resin (b) (the core resin (b1)) is higher than that in Comparative Examples 8 and 10 and lower than that in Comparative Examples 9 and 11. Thus, it can be concluded that, if Mn and a urethane group concentration of the core resin (b) are within a region surrounded by L21 to L24 shown in FIG. 2, viscoelasticity of the core resin can be optimized. L21 is a straight line in a case where an inequality sign on the left in Equation (1) above is an equal sign and L22 is a straight line in a case where an inequality sign on the right in Equation (1) above is an equal sign. L23 is a straight line in a case where an inequality sign on the left in Equation (2) above is an equal sign and L24 is a straight line in a case where an inequality sign on the right in Equation (2) above is an equal sign. From the foregoing, by using a polyester resin satisfying Equations (1) to (2) above as the core resin (b) and setting a content of nigrosine in the toner particles to not lower than 1 mass % and not higher than 20 mass %, it can be concluded that an image high in image density and excellent in glossiness is obtained. In addition, since the image has excellent glossiness, fixability of the toner particles is also considered as excellent.

In Comparative Examples 1 to 2, images were not excellent in glossiness. The reason for this may be because, in Comparative Examples 1 to 2, the core resin (b) (the core resins (b10) to (b11)) is not a resin satisfying Equations (1) to (2) above, and hence viscoelasticity of the core resin is not optimized.

In Comparative Example 3 as well, an image was not excellent in glossiness. The reason for this may be because nigrosine is not contained as a coloring agent in Comparative Example 3. Namely, unless nigrosine is contained as a coloring agent, a crystallization temperature of a crystalline resin is not lowered and therefore a surface of an image is not smoothened. Consequently, glossiness of an image is lowered.

In addition, in Comparative Example 12, image density was not excellent. The reason for this may be because a content of a coloring agent in the toner particles was too low in Comparative Example 12.

Moreover, in Comparative Example 13, both of image density and glossiness of an image were not excellent. The reason for this may be because a content of nigrosine in the toner particles was too high to sufficiently lower a crystallization temperature of a crystalline resin and thus transfer performance of the toner particles was lowered.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer, obtained by dispersing toner particles containing at least a resin and a coloring agent in an insulating liquid, said toner particles having a core-shell structure that first resin particles containing a first resin are attached to or cover surfaces of second resin particles containing a second resin, said coloring agent containing nigrosine, a content of said nigrosine in said toner particles being not lower than 1 mass % and not higher than 20 mass %, and said second resin satisfying $$-0.00003x+2.03 \leq y \leq -0.00003x+6.95 \quad \text{Equation (1)}$$

$$10000 \leq x \leq 60000 \quad \text{Equation (2)}$$

where x represents a number average molecular weight of said second resin and y represents a urethane group concentration (mass %) in said second resin.

2. The liquid developer according to claim 1, wherein said coloring agent contains nigrosine and carbon black, and a total content of nigrosine and carbon black in said toner particles is not lower than 15 mass % and not higher than 50 mass %.

3. The liquid developer according to claim 1, wherein said toner particles have a volume average particle size not smaller than 0.5 μm and not greater than 5 μm.

* * * * *